US009658582B2

(12) United States Patent
Ken et al.

(10) Patent No.: US 9,658,582 B2
(45) Date of Patent: May 23, 2017

(54) FUSING DEVICE EMPLOYING INDUCTION HEATING METHOD AND IMAGE FORMING APPARATUS USING THE SAME

(71) Applicant: SAMSUNG ELECTRONICS CO., LTD., Suwon-si (KR)

(72) Inventors: Chi Ken, Kanagawa (JP); Kanji Oka, Kanagawa (JP); Tatsunori Izawa, Kanagawa (JP); Takayuki Horie, Kanagawa (JP); Takayuki Yamada, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 42 days.

(21) Appl. No.: 14/874,928

(22) Filed: Oct. 5, 2015

(65) Prior Publication Data

US 2016/0124360 A1 May 5, 2016

(30) Foreign Application Priority Data

Oct. 29, 2014 (JP) ..... 2014-220364
Dec. 26, 2014 (KR) ..... 10-2014-0191134

(51) Int. Cl.
*G03G 15/20* (2006.01)

(52) U.S. Cl.
CPC ..... *G03G 15/2053* (2013.01); *G03G 15/2042* (2013.01); *G03G 2215/2025* (2013.01)

(58) Field of Classification Search
None
See application file for complete search history.

(56) References Cited

U.S. PATENT DOCUMENTS

| | | | |
|---|---|---|---|
| 6,320,168 | B1 | 11/2001 | Kimata et al. |
| 6,850,728 | B2 | 2/2005 | Yokozeki et al. |
| 7,184,697 | B2 | 2/2007 | Kinouchi et al. |
| 8,165,513 | B2 | 4/2012 | Kagawa |
| 2003/0068169 | A1 | 4/2003 | Suzuki |
| 2005/0031365 | A1 | 2/2005 | Takagi et al. |
| 2006/0062609 | A1 | 3/2006 | Kinouchi et al. |
| 2010/0258557 | A1 | 10/2010 | Kinouchi et al. |
| 2012/0045240 | A1 | 2/2012 | Shimizu |

(Continued)

FOREIGN PATENT DOCUMENTS

| | | | |
|---|---|---|---|
| EP | 1249740 | A2 | 10/2002 |
| EP | 2105805 | A1 | 9/2009 |

(Continued)

OTHER PUBLICATIONS

Communication dated Dec. 15, 2015 Issued by the International Searching Authority in counterpart International Patent Application No. PCT/KR2015/009612 (PCT/ISA/220, PCT/ISA/210, PCT/ISA/237).

*Primary Examiner* — David M Gray
*Assistant Examiner* — Thomas Giampaolo, II
(74) *Attorney, Agent, or Firm* — Staas & Halsey LLP

(57) ABSTRACT

A fusing device is provided. The fusing device includes a heating roller having two end regions and an inner region between the two end regions, a coil module, and a controller. The coil module includes a first coil arranged along an axial direction of the heating roller; two second coils, one second coil arranged in each end region of the heating roller; and a third coil arranged in the inner region of the heating roller. The controller controls current directions of currents in the first coil, the second coils, and the third coil.

25 Claims, 38 Drawing Sheets

(56) References Cited

U.S. PATENT DOCUMENTS

| | | | |
|---|---|---|---|
| 2013/0078019 | A1 | 3/2013 | Kim et al. |
| 2014/0064764 | A1 | 3/2014 | Kim et al. |

FOREIGN PATENT DOCUMENTS

| | | | |
|---|---|---|---|
| EP | 2388657 | A1 | 11/2011 |
| JP | 2003-98865 | A | 4/2003 |
| JP | 2003-317924 | A | 11/2003 |
| JP | 2006-91884 | A | 4/2006 |
| JP | 2012-42711 | A | 3/2012 |
| JP | 2014-92556 | A | 5/2014 |

FIG. 22

| PAPER TYPE | PAPER WIDTH | PAPER FEEDING STATE | | | NON-PAPER FEEDING STATE |
|---|---|---|---|---|---|
| | | TARGET TEMPERATURE + 3℃ OR ABOVE | WITHIN TARGET TEMPERATURE BETWEEN ±3℃ | TARGET TEMPERATURE −3℃ OR BELOW | BELOW TARGET TEMPERATURE |
| REGULAR PAPER | 301mm~ | A6 | A2 | A7 | A6 |
| | 251mm~300mm | A2 | A2 | A1 | A2 |
| | 201mm~250mm | A4 | A3 | A3 | A4 |
| | 151mm~200mm | A5 | A4 | A3 | A5 |
| | 101mm~150mm | OFF | A5 | A4 | A5 |
| | ~100mm | OFF | A5 | A5 | A5 |
| THICK PAPER | 301mm~ | A7 | A1 | A7 | A6 |
| | 251mm~300mm | A6 | A1 | A7 | A2 |
| | 201mm~250mm | A4 | A3 | A3 | A4 |
| | 151mm~200mm | A4 | A3 | A3 | A4 |
| | 101mm~150mm | A5 | A4 | A4 | A5 |
| | ~100mm | A5 | A4 | A5 | A5 |

FIG. 25

| PAPER TYPE | PAPER WIDTH | PAPER FEEDING STATE | | | NON-PAPER FEEDING STATE |
|---|---|---|---|---|---|
| | | TARGET TEMPERATURE + 3℃ OR ABOVE | WITHIN TARGET TEMPERATURE BETWEEN ±3℃ | TARGET TEMPERATURE −3℃ OR BELOW | BELOW TARGET TEMPERATURE |
| REGULAR PAPER | 301mm~ | B12 | B2 | B1 | B11 |
| | 251mm~300mm | B2 | B2 | B1 | B2 |
| | 201mm~250mm | B9 | B4 | B3 | B9 |
| | 151mm~200mm | B9 | B7 | B6 | B9 |
| | 101mm~150mm | B10 | B8 | B5 | B10 |
| | ~100mm | OFF | B10 | B5 | B10 |
| THICK PAPER | 301mm~ | B12 | B1 | B1 | B11 |
| | 251mm~300mm | B2 | B1 | B1 | B2 |
| | 201mm~250mm | B9 | B3 | B3 | B9 |
| | 151mm~200mm | B9 | B6 | B6 | B9 |
| | 101mm~150mm | B10 | B5 | B5 | B10 |
| | ~100mm | B10 | B5 | B5 | B10 |

FUSING DEVICE EMPLOYING INDUCTION HEATING METHOD AND IMAGE FORMING APPARATUS USING THE SAME

CROSS-REFERENCE TO RELATED APPLICATION

This application claims priority from Korean Patent Application No. 10-2014-0191134, filed on Dec. 26, 2014, in the Korean Intellectual Property Office, and Japanese Patent Application No. 2014-220364, filed on Oct. 29, 2014, in Japan Patent Office, the disclosures of which are incorporated by reference herein in their entireties.

BACKGROUND

1. Field

The present disclosure relates to a fusing device employing an induction heating method and an image forming apparatus including the fusing device.

2. Description of the Related Art

A fusing device of an image forming apparatus, for example, an induction heating fusing device that provides different coils for different widths of paper is known.

However, there is a disadvantage that currents flowing through the coils are different for different widths of papers, which causes a disadvantage of a non-uniform temperature distribution. This non-uniform temperature distribution affects the image quality.

SUMMARY

It is an aspect to provide an induction heating fusing device that heats a heating element so that a temperature distribution thereof is uniform and an image forming apparatus including the induction heating fusing device.

According to an aspect of one or more exemplary embodiments, there is provided a fusing device comprising a heating element that is rotatable; and a coil module circuit configured to generate a magnetic flux for heating the heating element and comprising a coil module facing an outer circumference surface of the heating element and arranged to be separated from the outer circumference surface of the heating element in a facing direction, and a power supply configured to supply power to the coil module, wherein the coil module comprises a first coil arranged in a widthwise direction of the heating element; a pair of second coils arranged to overlap in the facing direction both end portions of the first coil in the widthwise direction; and a third coil arranged to overlap in the facing direction a central portion of the first coil in the widthwise direction, and wherein the coil module circuit comprises a switching connection unit configured to switch serial connections of the first coil, the second coils, and the third coil in order to switch current directions of the first coil, the second coils, and the third coil.

A number of turns of each of the second coils may be less than a number of turns of the first coil.

In a rotation direction of the heating element, inner widths of the second coils and the third coil may be greater than an inner width of the first coil, and outer widths of the second coils and the third coil may be less than an outer width of the first coil.

The second coils and the third coil may be at same distance from the heating element in the facing direction and have a same number of turns.

The second coils and the third coil may be arranged to have a structure in which end portions of the second coils and the third coil in the widthwise direction are adjacent to each other, a structure in which the end portions of the second coils and the third coil in the widthwise direction are separated from each other, or a structure in which a distance from the heating element to the second coils in the facing direction is different from a distance from the heating element to the third coil in the facing direction and the end portions of the second coils and the third coil in the widthwise direction overlap each other.

The fusing device may further comprise a core module configured to concentrate magnetic fluxes generated by the first coil, the second coils, and the third coil toward the heating element, the core module comprising a plurality of cores, wherein the core module is arranged to overlap at least the second coils and the third coil in the widthwise direction.

The first coil may be arranged closer to the core module than the second coils and the third coils in the facing direction.

The core module may comprise a connection unit configured to overlap in the facing direction a connection region between the third coil and the second coils; and a main unit configured to overlap a region of the coil module other than the connection region, wherein the connection unit and the main unit have a structure in which the connection unit and the main unit have the same arrangement densities and the same permeability, a structure in which permeabilities of the connection unit and the main unit are different from each other, or a structure in which distances from the heating element to the connection unit and the main unit in the facing direction are different from each other.

A ratio of magnetic fluxes generated by the second coils and the third coil to a magnetic flux generated by the first coil may be less than or equal to about 50%.

The coil module may further comprise a pair of fourth coils arranged to overlap in the facing direction the end portions of the first coil and the second coils in the widthwise direction; and a fifth coil arranged to overlap in the facing direction the central portions of the first coil and the third coil in the widthwise direction, wherein a ratio of a length of the fourth coil to a length of the fifth coil in the widthwise direction is different from a ratio of a length of the second coils to a length of the third coil in the widthwise direction, the switching connection unit is configured to switch serial connections of the first coil, the second coils, the third coil, the fourth coils, and the fifth coil such that the first coil, the second coils, the third coil, the fourth coils, and the fifth coil are connected in series and current directions of the first coil, the second coils, the third coil, the fourth coils, and the fifth coil are switched.

A ratio of magnetic fluxes generated by the fourth coils and the fifth coil to a magnetic flux generated by the first coil may be less than or equal to about 50%.

The coil module circuit may further comprise a controller configured to control at least one of the power supply and the switching connection unit, wherein the controller is further configured to set a control pattern of the at least one of the power supply and the switching connection unit at a time at which paper is ready to be fed to the fusing device, at a time at which paper starts being fed to the fusing device, at a time at which paper is continuously fed to the fusing device, and at a time at which paper is finished being fed to the fusing device.

The control patterns may comprise a pattern for setting supply and interruption of power supply by the power supply.

The control patterns may comprise a pattern for setting a serial connection type of the coil module, the setting being performed by the switching connection unit.

The controller may operate based on a plurality of control patterns.

The controller may be further configured to determine a control pattern from among the plurality of control patterns according to at least one of a width of a recording medium, a thickness of a recording medium, and a difference between a measured temperature and a target temperature of the heating element.

The fusing device may further comprise a first temperature detection sensor configured to detect a temperature of a region overlapping in the facing direction central portions of the first coil and the third coil in the widthwise direction, from among regions of the heating element; and a second temperature detection sensor configured to detect a temperature of a region overlapping in the facing direction a region where the first coil overlaps the second coils in the facing direction, from among the regions of the heating element.

The coil module may further comprise a pair of fourth coils arranged to overlap in the facing direction end portions of the first coil and the second coils in the widthwise direction; and a fifth coil arranged to overlap in the facing direction central portions of the first coil and the third coil in the widthwise direction, wherein the fifth coil is arranged to overlap in the facing direction an end portions of the second coils, which are adjacent to the third coil, the fusing device further comprises a third temperature detection sensor configured to detect a temperature of a region overlapping in the facing direction a region where the second coils overlap the fifth coil from among regions of the heating element, the first temperature detection sensor is configured to detect a temperature of a region overlapping in the facing direction the central portions of the first coil and the third coil and a central portion of the fifth coil in the widthwise direction, from among regions of the heating element, and the second temperature detection sensor is configured to detect a temperature of a region overlapping in the facing direction a region where the first coil, the second coils, and the fifth coil overlap each other, from among the regions of the heating element.

When a first recording medium, a second recording medium having a greater width than the first recording medium, and a third recording medium having a greater width than the second recording medium are fed to the fusing device, a length of the first coil in the widthwise direction may be greater than a width of the third recording medium, a length of the third coil in the widthwise direction may be less than a width of the second recording medium, but is greater than a width of the first recording medium, and a length of the fifth coil in the widthwise direction may be less than a width of the third recording medium, but is greater than the width of the second recording medium.

According to another aspect of one or more exemplary embodiments, there is provided an image forming apparatus comprising a fusing device comprising a heating element that is rotatable; and a coil module circuit configured to generate a magnetic flux for heating the heating element and comprising a coil module facing an outer circumference surface of the heating element and arranged to be separated from the outer circumference surface of the heating element in a facing direction, and a power supply configured to supply power to the coil module, wherein the coil module comprises a first coil arranged in a widthwise direction of the heating element; a pair of second coils arranged to overlap in the facing direction both end portions of the first coil in the widthwise direction; and a third coil arranged to overlap in the facing direction a central portion of the first coil in the widthwise direction, and wherein the coil module circuit comprises a switching connection unit configured to switch serial connections of the first coil, the second coils, and the third coil in order to switch current directions of the first coil, the second coils, and the third coil.

According to another aspect of one or more exemplary embodiments, there is provided a fusing device comprising a heating roller having two end regions and an inner region between the two end regions; a coil module comprising a first coil arranged along an axial direction of the heating roller; two second coils, one second coil arranged in each end region of the heating roller; and a third coil arranged in the inner region of the heating roller; and a controller configured to control current directions of currents in the first coil, the second coils, and the third coil.

The controller may control the current directions of the currents in the first coil, the second coils, and the third coil to be in the same direction, or the controller controls the current directions of the currents in the first coil and the third coil to be opposite to the current direction of the currents in the second coils.

The fusing device may further comprise a core module configured to concentrate magnetic fluxes generated by the first coil, the second coils, and the third coil toward the heating element, the core module comprising a plurality of cores, wherein the cores are arranged at intervals along the axial direction.

The cores may be arranged to overlap seams between the third coil and the second coils.

The coil module may further comprise two fourth coils, one fourth coil arranged in a portion of each end region; and a fifth coil arranged in a region between the fourth coils, wherein each second coil overlaps a corresponding seam between the fifth coil and the fourth coils, and wherein the controller further controls current directions of currents in the fourth coils and the fifth coil.

BRIEF DESCRIPTION OF THE DRAWINGS

These and/or other aspects will become apparent and more readily appreciated from the following description of the exemplary embodiments, taken in conjunction with the accompanying drawings in which:

FIG. 22 illustrates a graph for explaining a relationship between various conditions and the control patterns of FIGS. 21A to 21G;

FIG. 25 illustrates a graph for explaining a relationship between various conditions and the control patterns of FIG. 23 and FIG. 24;

DETAILED DESCRIPTION

Figure 1:
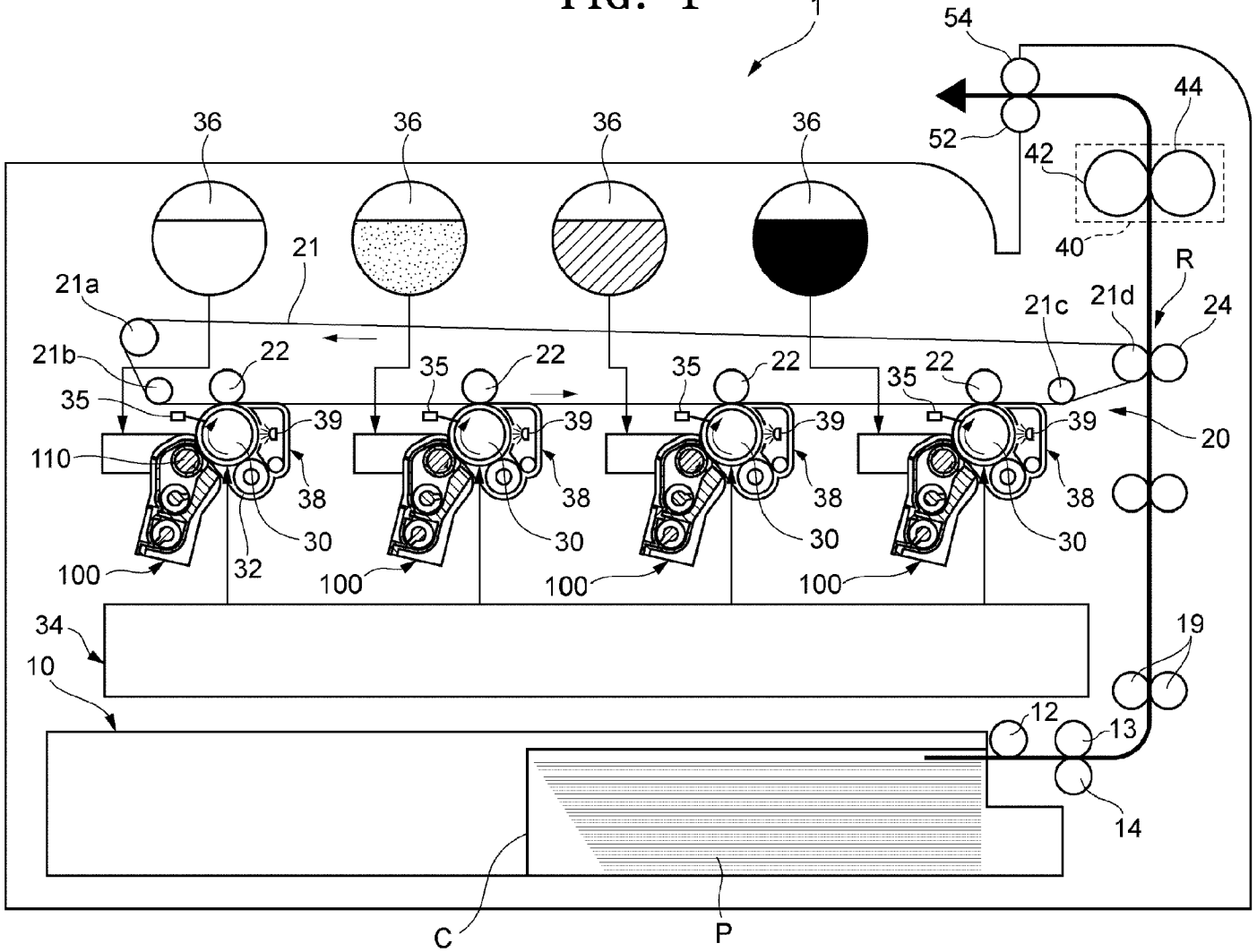
FIG. 1 illustrates a schematic structure of an image forming apparatus according to a first exemplary embodiment.

Hereinafter, exemplary embodiments will be described in detail by explaining the exemplary embodiments with reference to the attached drawings. Like reference numerals in the drawings denote like elements, and repeated descriptions thereof will be omitted.

An induction heating fusing device may include a first coil for heating a heating element according to a maximum width of paper that may be fed to an image forming apparatus, and a second coil arranged to overlap the first coil from both end portions of the first coil in a widthwise direction. Also, the induction heating fusing device may further include a power supply configured to provide power to the first coil and the second coil and a switch configured to control currents flowing in the first coil and the second coil to flow in the same direction or different directions.

In such a configuration, when paper (e.g., paper overlapping the second coil) having a large width passes through the induction heating fusing device, currents flowing in the same direction are applied to the first coil and the second coil. When paper (e.g., paper that does not overlap the second coil) having a small width passes through the induction heating fusing device, currents flowing in different directions are applied to the first coil and the second coil. Thus, when paper having a small width passes through the induction heating fusing device, generation of a magnetic flux in a portion where paper does not pass through a heating element (a non-paper feeding portion) and a temperature increase in the paper non-feeding unit may be restricted.

Non-uniform temperature distribution of a heating element of a fusing device may affect the quality of an image. For example, when the temperature distribution of the heating element is non-uniform, gloss on a printed image may be non-uniform. Also, when a temperature in a portion of the heating element is higher than a temperature for fixing an image, energy (power) is unnecessarily consumed by an induction heating fusing device.

Exemplary embodiments address these and other disadvantages.

First Exemplary Embodiment (Whole Structure of an Image Forming Apparatus)

As illustrated in FIG. 1, an image forming apparatus 1 may include a transport unit 10, a transfer unit 20, photoreceptor drums 30, four developing units 100, and a fusing device 40. The image forming apparatus 1 is, for example, an electrophotographic image forming apparatus.

The transport unit 10 accommodates paper P (media) used as a recording medium on which an image is finally formed and transports the paper P to a transport path. The paper P is stacked in a cassette C. The transport unit 10 completes transportation of the paper P to a second transfer region R at a time when a toner image reaches the second transfer region R.

The transfer unit 20 moves a toner image formed by the developing units 100 to the second transfer region R in order to secondarily transfer the toner image on the paper P. The transfer unit 20 may include a transfer belt 21, suspension rollers 21*a*, 21*b*, 21*c*, and 21*d*, primary transfer rollers 22, and a secondary transfer roller 24. The transfer belt 21 is supported by the suspension rollers 21*a*, 21*b*, 21*c*, and 21*d*. The transfer belt 21 is disposed between the primary transfer rollers 22 and the corresponding photoreceptor drums 30 and disposed between the secondary transfer roller 24 and the suspension roller 21*d*.

The transfer belt 21 is a seamless belt that is circulated by operation of the suspension rollers 21*a*, 21*b*, 21*c*, and 21*d*. The primary transfer rollers 22 are installed to press the corresponding photoreceptor drums 30 from an inner circumference of the transfer belt 21. The secondary transfer roller 24 is installed to press the suspension roller 21*d* from an outer circumference of the transfer belt 21. Also, the transfer unit 20 may further include a belt cleaning device or the like. The belt cleaning device is configured to remove a toner attached to the transfer belt 21.

Each photoreceptor drum 30 is a drum-shaped latent image carrier, and an image is formed on an outer circumference surface thereof. Each photoreceptor drum 30 may include, for example, an organic photo conductor (OPC). The image forming apparatus 1 may form color images. Along a movement direction of the transfer belt 21, four photoreceptor drums 30 are installed in the image forming apparatus 1 in accordance with several colors, for example, magenta, yellow, cyan, and black. However, although four photoreceptor drums 30 are illustrated, this number is only exemplary, and the number may be more or less than four. Each photoreceptor drum 30 is driven by a drum motor 35. A charging roller 32, an exposure unit 34, the drum motor 35, a cleaning unit 38, and a developing unit 100 are installed along a circumference of each photoreceptor drum 30.

A charging voltage is applied to the charging roller 32, and thus, a surface of the photoreceptor drum 30 is evenly charged at an electric potential. The electric potential may be predetermined. The charging roller 32 is installed in a vicinity of or to be in contact with the photoreceptor drum 30 and evenly charges the photoreceptor drum 30 by a discharge caused in a micro gap. The exposure unit 34 exposes the surface of the photoreceptor drum 30, which is charged by the charging roller 32, to light according to information of an image to be formed on the paper P. Accordingly, an electric potential of the surface of the photoreceptor drum 30, which is exposed by the exposure unit 34, changes, and thus, an electrostatic latent image is formed. As a developing voltage is applied to the developing units 100, the developing units 100 develop the electrostatic latent image. In detail, each developing unit 100 generates a toner image by developing the electrostatic latent image, which is formed on the photoreceptor drum 30 by a toner provided by a toner tank 36. Magenta, yellow, cyan, and black toners are respectively filled in four toner tanks 36.

The cleaning unit 38 collects a toner (i.e., a residual toner) that remains on the photoreceptor drum 30 after the toner is temporarily transferred to the transfer belt 21. The cleaning unit 38 may include, for example, a cleaning blade, and removes the residual toner as the cleaning blade comes into contact with the outer circumference surface of the photoreceptor drum 30. Also, the cleaning unit 38 may include a static electricity removing lamp 39 that is arranged adjacent to an outer circumference of the photoreceptor drum 30 and controls the electric potential of the surface of the photoreceptor drum 30. The static electricity removing lamp 39 is an erase lamp irradiating light onto the surface of the photoreceptor drum 30 for removing static electricity from the surface of the photoreceptor drum 30. The static electricity removing lamp 39 operates during a printing operation and the electric potential of the surface of the photoreceptor drum 30 has a desired value. Also, the static electricity removing lamp 39 operates in a non-printing period, for example, in a period after a transfer operation is completed, and residual charges of the photoreceptor drum 30 have a voltage less than an optical attenuation voltage so that the electric potential of the surface of the photoreceptor drum 30 is reset. Instability of a charging potential caused by the residual charges may be solved and generation of ghosts in an image may be restricted by the static electricity removing lamp 39. The non-printing period includes periods before and after the printing operation and periods when an image is not formed between pages while multi-page printing is performed.

The fusing device 40 may include a pressing rotor 42 and a heating rotor 44. The fusing device 40 presses a toner image, which is secondarily transferred to the paper P from the transfer belt 21, to the paper P and fuses the pressed toner image. The fusing device 40 will be later described in detail.

Also, the image forming apparatus 1 includes discharge rollers 52 and 54 for discharging the paper P, on which the toner image is fused by the fusing device 40, to the outside of the image forming apparatus 1.

Operations of the image forming apparatus 1 will be described below. When an image signal of an image to be recorded is input to the image forming apparatus 1, a controller of the image forming apparatus 1 evenly charges the surface of the photoreceptor drum 30 via the charging roller 32 at an electric potential and forms an electrostatic latent image via a laser beam irradiated onto the photoreceptor drum 30 by the exposure unit 34. The laser beam is modulated to correspond to the image signal.

A two-component type developing agent is carried by the developing roller 110 in the developing units 100. The developing agent includes a toner and a carrier. The developing units 100 sufficiently mix and charge the toner and carrier. When the developing agent is moved to a region facing the photoreceptor drum 30 due to rotation of the developing roller 110, the toner included in the developing agent is moved to the electrostatic latent image formed on the outer circumference surface of the photoreceptor drum 30. Accordingly, the electrostatic latent image is developed by the toner into a toner image. The toner image is primarily transferred from the photoreceptor drum 30 to the transfer belt 21 in a region where the photoreceptor drum 30 faces the transfer belt 21. Toner images formed on the four photoreceptor drums 30 are sequentially stacked on the transfer belt 21, and thus, a single stacked toner image is formed. Then, the stacked toner image is secondarily transferred from the transfer belt 21 to the paper P transported by the transport unit 10 in the second transfer region R where the suspension roller 21*d* faces the secondary transfer roller 24.

The paper P, on which the stacked toner image is secondarily transferred, is transported to the fusing device 40.

When the paper P is transported while being heated and pressed between the heating rotor 44 and the pressing rotor 42, the stacked toner image is melted and fused on the paper P. Then, the paper P is discharged to the outside of the image forming apparatus 1 by the discharge rollers 52 and 54. Also, when the transfer unit 20 includes a belt cleaning device, the belt cleaning device may remove a toner remained on the transfer belt 21 after the stacked toner image is secondarily transferred to the paper P.

(Structure of the Fusing Device)

Figure 2:
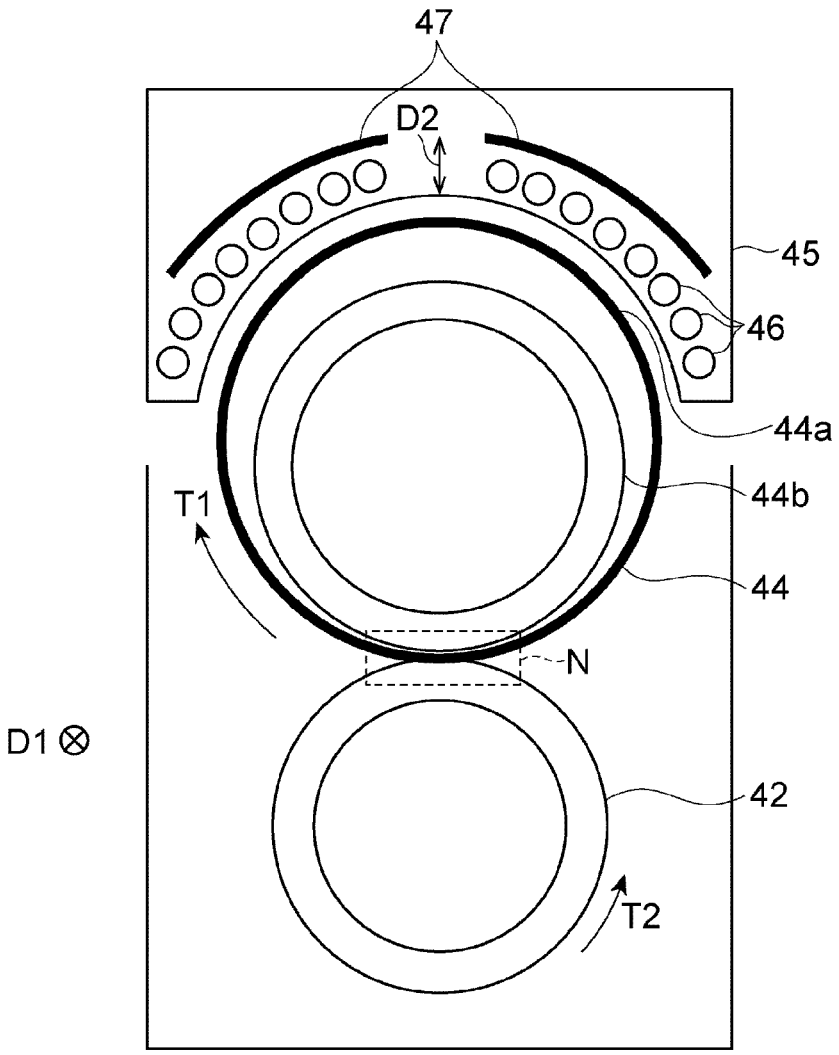
FIG. 2 illustrates a schematic diagram of the image forming apparatus of FIG. 1.

A detailed structure of the fusing device 40 will be described with reference to FIG. 2. As illustrated in FIG. 2, the fusing device 40 is an induction heating fusing device including the pressing rotor 42, the heating rotor 44, and a magnetic field generator 45. Also, the magnetic field generator 45 may include coil module 46 facing an outer circumference surface 44*a* of the heating rotor 44 and a core module 47 concentrating a magnetic flux generated by the coil module 46 to the heating rotor 44.

The pressing rotor 42 is a cylindrical rotor installed to press the heating rotor 44 and may include, for example, silicon rubber having a hardness of JISA65. A surface of the pressing rotor 42 may be coated with fluororesin in order to increase a wear resistance and a releasability. Also, the pressing rotor 42 may include a sponge type foaming body. In addition, the pressing rotor 42 may include a material having a low thermal conductivity in order to prevent thermal diffusion. A length of the pressing rotor 42 in an axial direction is, for example, from about 210 mm to about 370 mm, and an external diameter thereof is, for example, from about 20 mm to about 100 mm.

The heating rotor 44 is a cylindrical rotor (i.e., a rotatable heating element) having a heating layer and may have a multilayer structure including metal conductors that are magnetic materials such as nickel (Ni), chrome (Cr), or copper (Cu). A surface of the heating rotor 44 may be coated with fluororesin in order to increase a wear resistance and releasability. In this case, the heating rotor 44 having a multilayer structure may include a heating layer of about 10-50 μm, a rubber layer of about 50-500 μm, and a fluororesin layer of about 10-50 μm. A length of the heating rotor 44 in an axial direction is, for example, from about 210 mm to about 370 mm, and an external diameter thereof is, for example, from about 20 mm to about 100 mm.

The heating rotor 44 emits heat due to a magnetic flux generated in the coil module 46. That is, the magnetic flux generated in the coil module 46 is induced to the outer circumference surface 44*a* of the heating rotor 44 by the core module 47. As Joule's Heat is generated on the outer circumference surface 44*a* of the heating rotor 44 because of an eddy current generated by the magnetic flux, the heating rotor 44 emits heat. When the heating rotor 44 performs a fusing operation, a surface temperature of the heating rotor 44 may range, for example, from about 140° Cto about 200° C.

A nip forming member 44*b* that is a cylindrical rotor is positioned on an inner circumference surface of the heating rotor 44. A rotation axis of the nip forming member 44*b* is parallel to that of the heating rotor 44. The nip forming member 44*b* presses the heating rotor 44 from the inner circumference surface of the heating rotor 44 toward the pressing rotor 42. The heating rotor 44 rotates in a direction (a rotation direction T1) by a rotation motor (not shown), and the pressing rotor 42 rotates in a rotation direction T2 opposite the rotation direction T1. The pressing rotor 42 and the heating rotor 44 make the paper P pass through a fusing nip potion N that is a contact region where the pressing rotor 42 contacts the heating rotor 44, and thus, the toner image is melted and fused on the paper.

The coil module 46 is a magnetic flux generating element configured to generate a magnetic flux by electromagnetic induction when a high-frequency current is applied thereto. An output frequency of the coil module 46 may be, for example, from about 20 kHz to about 100 kHz. The coil module 46 is arranged on an opposite side of the pressing rotor 42 with respect to the heating rotor 44 and may cover about half of the outer circumference of the heating rotor 44. The coil module 46 does not contact the heating rotor 44 and is arranged adjacent to the outer circumference surface 44*a*. A distance between the coil module 46 and the heating rotor 44 may be, for example, from about 1 mm to about 10 mm. The coil module 46 extends between end portions of the heating rotor 44 in an axial direction D1 (a widthwise direction of the heating rotor 44) of the heating rotor 44.

The core module 47 is arranged to cover the coil module 46 and is a magnetic substance core for forming a magnetic circuit for the magnetic flux generated in the coil module 46. The core module 47 receives the magnetic flux and induces the received magnetic flux to the heating rotor 44 such that the magnetic flux generated in the coil module 46 does not leak. The core module 47 is arranged on an opposite side of the heating rotor 44 with respect to the coil module 46, such that the coil module 46 is between the core module 47 and the heating rotor 44. The core module 47 is arranged close to the coil module 46 without contacting the coil module 46, and the distance between the coil module 46 and the core module 47 may be, for example, from about 1 mm to about 10 mm. The core module 47 may be formed of a high permeable and low-loss magnetic material, for example, ferrite.

Figure 3:
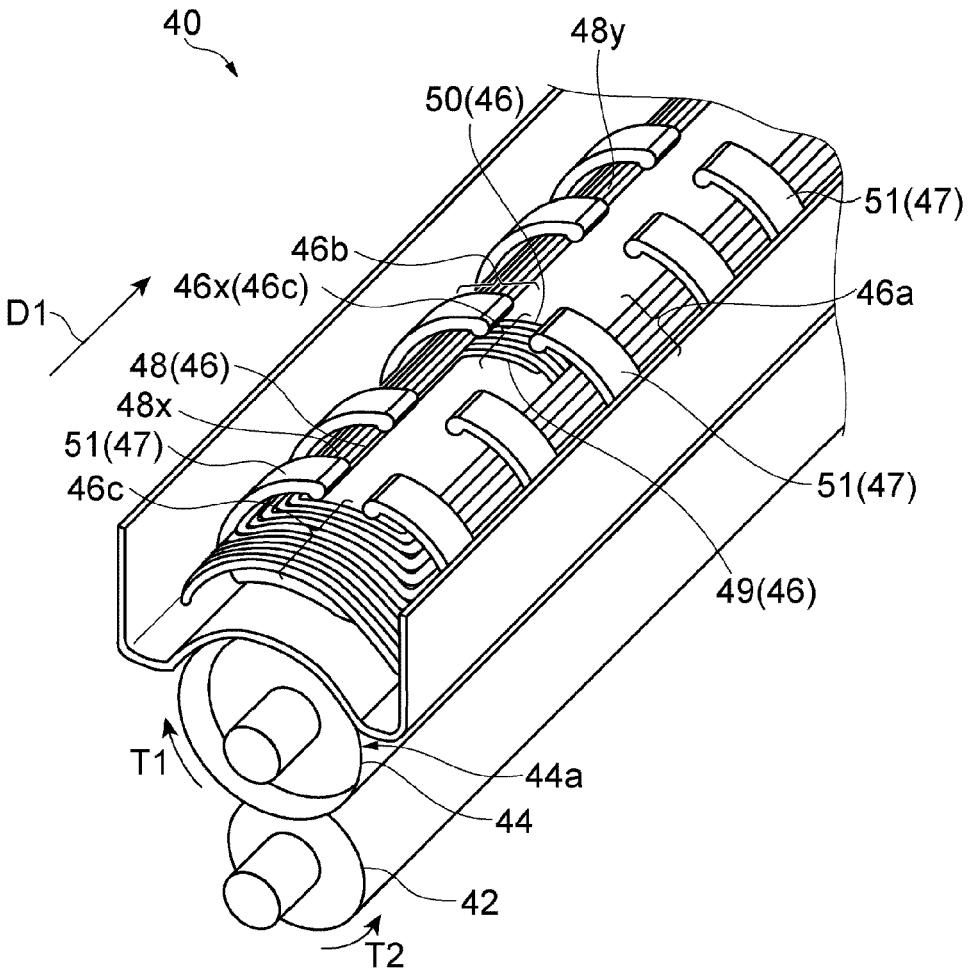
FIG. 3 illustrates a perspective view of a fusing device of FIG. 2.
Figure 4:
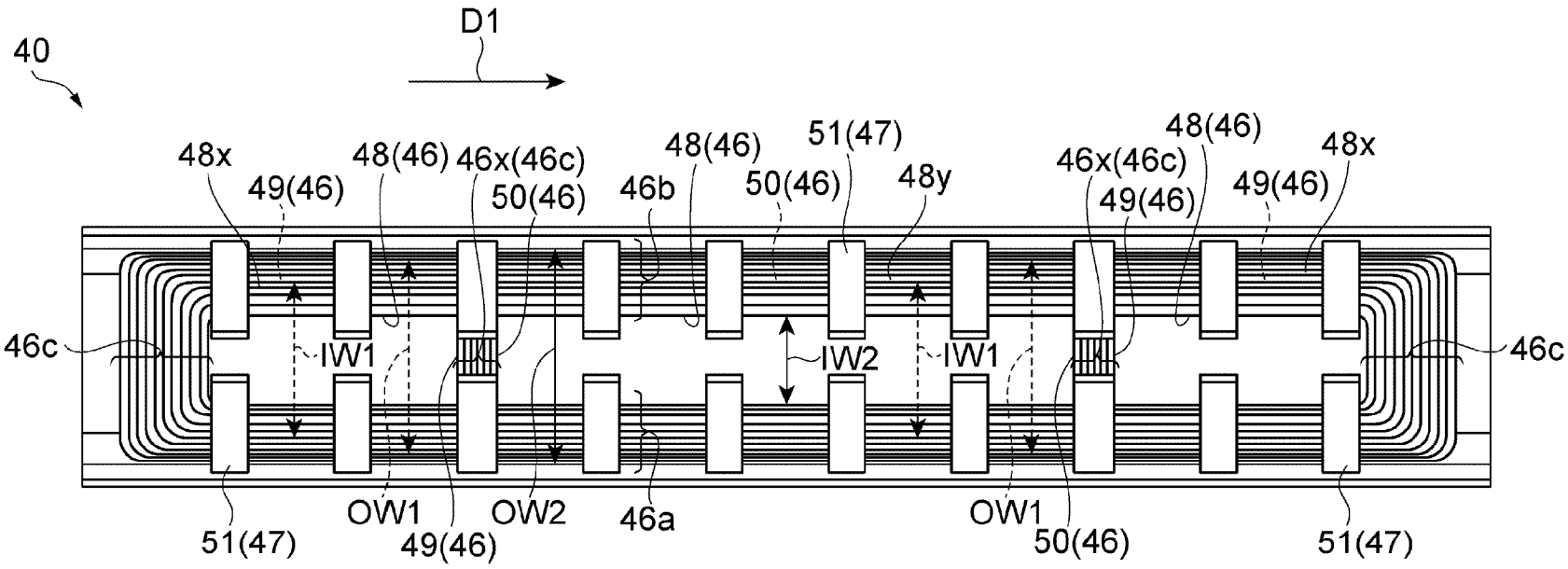
FIG. 4 illustrates a plan view of a coil and a core module of the fusing device of FIG. 3.
Figure 5:
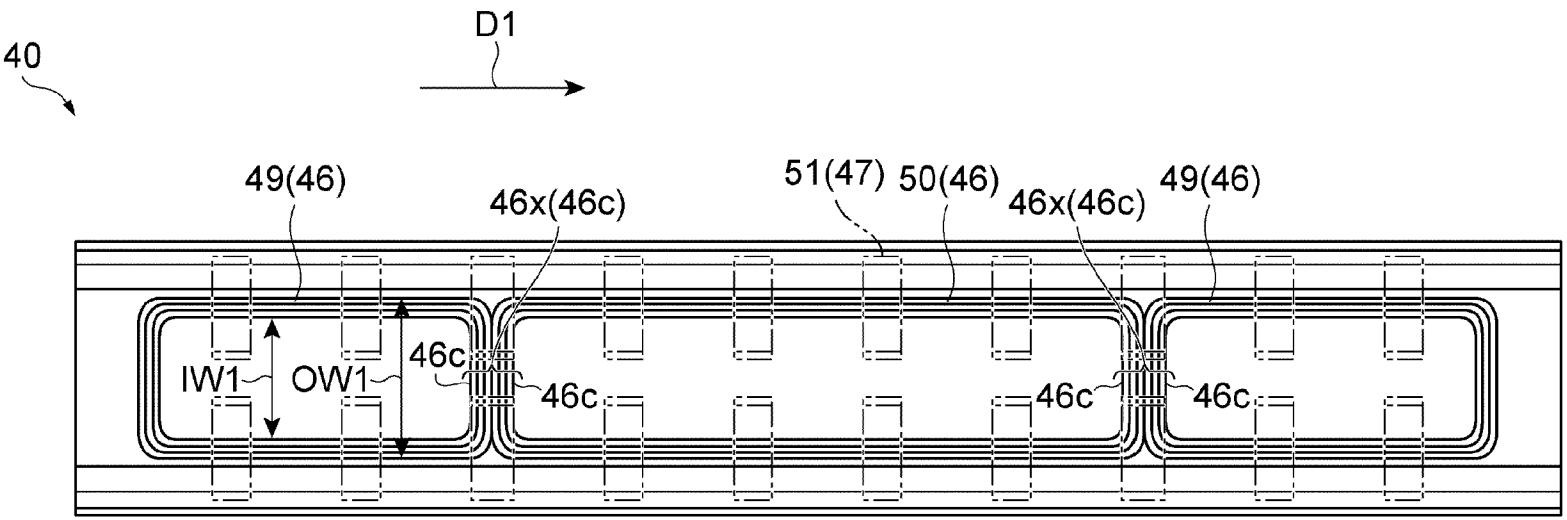
FIG. 5 illustrates a plan view of the fusing device of FIG. 2 without the coil and the core module of FIG. 4.

The coil module 46 and the core module 47 are described in detail with reference to FIGS. 3 to 5. As illustrated in FIGS. 3 to 5, the coil module 46 is a coil of a race track type (semicircular shaped) and extends in the axial direction D1 and the rotation direction T1. The coil module 46 includes a pair of straight portions 46*a* and 46*b*, which extend in the axial direction D1 and are arranged parallel to each other in the rotation direction T1, and a pair of circular arc portions 46*c* which are respectively connected to end portions of the straight portions 46*a* and 46*b* and extend in the rotation direction T1. Coil lines of the coil module 46 are arranged in parallel in the axial direction D1 and the rotation direction T1 so that thicknesses of the coil lines are small.

The coil module 46 includes a first coil 48, a pair of second coils 49, and a third coil 50. The first coil 48 is arranged in the axial direction D1. A length of the first coil 48 may be equal to that of the heating rotor 44 or may be slightly greater than that of the heating rotor 44 in the axial direction D1. The first coil 48 overlaps, in a facing direction D2 (of FIG. 2), almost an entire portion of an outer circumference surface of the heating rotor 44 in the axial direction D1. Lengths of the second coils 49 may less than half of a length of the heating rotor 44 in the axial direction D1. The second coils 49 overlap in the facing direction D2 both end portions 48*x* of the first coil 48 in the axial direction D1. The third coil 50 overlaps in the facing direction D2 a central portion 48*y* of the first coil 48 in the axial direction D1. Also, the first coil 48, the second coils 49, and the third coil 50 respectively have the straight portions 46*a* and 46*b* and the circular arc portions 46*c*.

Respective distances between the outer circumference surface 44*a* of the heating rotor 44 and the second coils 49 and between the outer circumference surface 44*a* of the heating rotor 44 and the third coil 50 may be less than a distance between the outer circumference surface 44*a* of the heating rotor 44 and the first coil 48. That is, the second coils 49 and the third coil 50 may be arranged to be closer to the heating rotor 44 than the first coil 48.

The second coils 49 and the third coil 50 may be at the same distance from the heating rotor 44 in the facing direction D2. Also, with respect to the axial direction D1, the third coil 50 is arranged in a region different from a region where the second coils 49 are arranged so that the third coil 50 is arranged between the second coils 49 (refer to FIG. 5). The circular arc portion 46*c* of the second coils 49 is arranged to be adjacent to the circular arc portion 46*c* of the third coil 50 in the axial direction D1. A connection region 46*x* is formed by the circular arc portion 46*c* of the second coils 49 and the circular arc portion 46*c* of the third coil 50 which are adjacent to each other. That is, the connection region 46*x* is a region from the circular arc portion 46*c*, which is an end portion of the second coil 49 and is adjacent to the third coil 50, to the circular arc portion 46*c* that is an end portion of the third coil 50. That is, the connection region 46*x* includes the circular arc portion 46*c* of the second coils 49 and the circular arc portion 46*c* of the third coil 50. A sum of a length of the second coils 49 in the axial direction D1 and a length of the third coil 50 in the axial direction D1 may be almost equal to a length of the first coil 48 in the axial direction D1. Also, with respect to the axial direction D1, a location of the circular arc portion 46*c* that is an end portion of the second coils 49, which is opposite to the third coil 50, may be almost the same as a location of the circular arc portion 46*c* that is an end portion of the first coil 48.

The numbers of turns of the second coils 49 and the third coil 50 may be equal to each other and may be less than the number of turns of the first coil 48. For example, the number of turns of the first coil 48 may be 6 to 30 turns, and the numbers of turns of the second coils 49 and the third coil 50 may be 1 to 5 turns. The number of turns of the second coils 49 and that of the third coil 50 may be 10% to 50% of the number of turns of the first coil 48, and for example, may be 10% to 30% of the number of turns of the first coil 48. Coil lines of each of the first coil 48, the second coils 49, and the third coil 50 may include, for example, litz wires having a diameter of 0.08 mm to 0.8 mm (e.g., 0.1-0.3 mm) and a number of twists of 1 to 200 (e.g., 20-150). The coil lines of each of the second coils 49 and the third coil 50 may have the same diameter and number of twists.

Also, inner widths IW1 of the second coils 49 and the third coil 50 in the rotation direction T1 may be greater than an inner width IW2 of the first coil 4 in the rotation direction T1 (see FIG. 5). Outer widths OW1 of the second coils 49 and the third coil 50 in the rotation direction T1 may be less than an outer width OW2 of the first coil in the rotation direction T1. That is, the second coils 49 and the third coil 50 may be arranged inside the first coil 48 in the rotation direction T1.

The core module 47 includes multiple cores 51. The cores 51 are arranged at regular intervals in parallel to one another in the axial direction D1 such that the cores 51 respectively overlap the straight portions 46*a* and 46*b* in the facing direction D2. The cores 51 are arranged to overlap the second coils 49 and the third coil 50. An arrangement density of the cores 51 of the core module 47 may be constant in the axial direction D1. Also, permeability of the cores 51 may be the same, and distances between the coil module 46 and the cores 51 may be the same. In addition, the first coil 48 may be arranged closer to the core module 47 than the second coils 49 and the third coil 50 in the facing direction D2.

Power supplied to the coil module 46 is described with reference to FIGS. 6A and 6B, and FIGS. 7A and 7B. Also, for convenience, FIGS. 6A and 6B, and FIGS. 7A and 7B illustrate changed locations of the second coils 49 and the third coil 50 in the facing direction D2. The coil module circuit 61 generates a magnetic flux for heating the heating rotor 44. The coil module circuit 61 includes a coil module 46, a power supply 62 and a circuit unit 63. The coil module 46 is included in the coil module circuit 61 and receives power. The power supply 62 includes an inverter configured to provide power to the coil module 46. The circuit unit 63 connects the coil module 46 and the power supply 62. The circuit unit 63 includes the switching connection unit 64. The switching connection unit 64 connects the first coil 48, the second coils 49, and the third coil 50 in series and switches serial connection types of each coil so that a current direction of each coil is switched. The switching connection unit 64 is a switch disposed between the first coil 48 and the second coils 49 and switches the current directions of the first coil 48 and the third coil 50 to be the same as or different from the current direction of the second coils 49. Also, the current directions of the first coil 48 and the third coil 50 are the same.

Figure 6A:
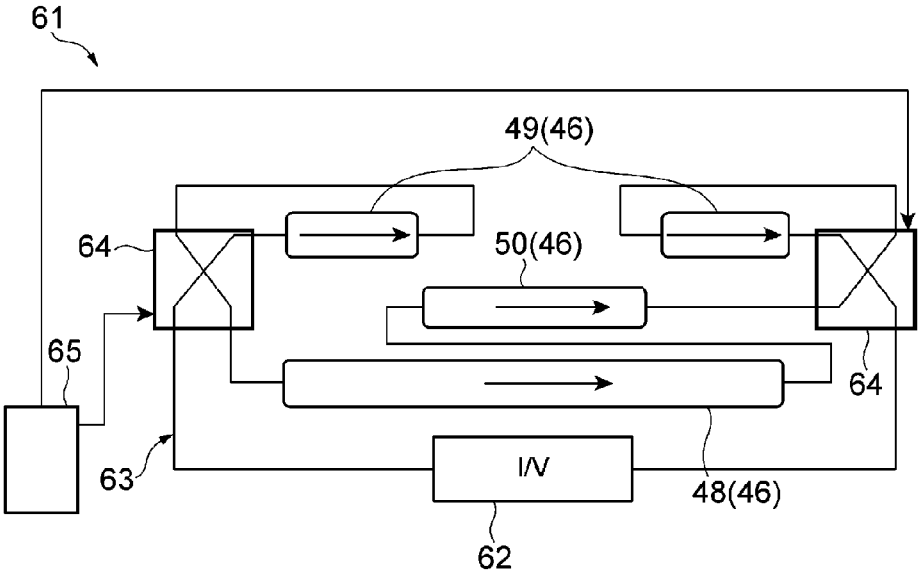
FIGS. 6A and 6B illustrate, respectively, a coil module circuit diagram of a first serial connection type and a temperature distribution of a heating rotor.
Figure 6B:
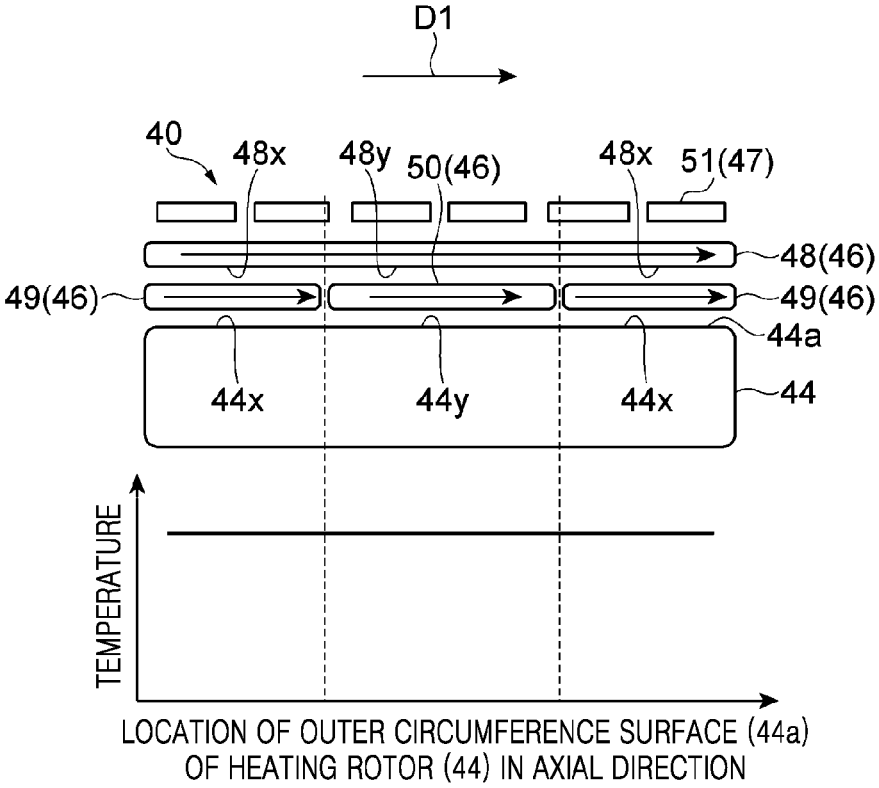

In detail, the switching connection unit 64 may be switched to form serial connections of two types (a first serial connection type and a second serial connection type). According to the first serial connection type, as illustrated in FIG. 6A, respective coils are connected to each other in series so that the current directions of the first coil 48 and the third coil 50 are the same as the current direction of the second coils 49. Since the current directions of the second coils 49 and the third coil 50 are the same as the current direction of the first coil 48, a magnetic flux density in the outer circumference surface 44*a* of the heating rotor 44 becomes almost constant in the axial direction D1. As a result, as illustrated in FIG. 6B, a temperature in the outer circumference surface 44*a* of the heating rotor 44 becomes almost constant in the axial direction D1. The first serial connection type is selected when fed paper has a relatively large width. The paper having a relatively large width may indicate, for example, paper having a large width so that the paper almost contacts portions of the heating rotor 44 which face the second coils 49 (end portions 44*x*). Hereinafter, the paper having a relatively large width will be referred to as first paper.

Figure 7A:
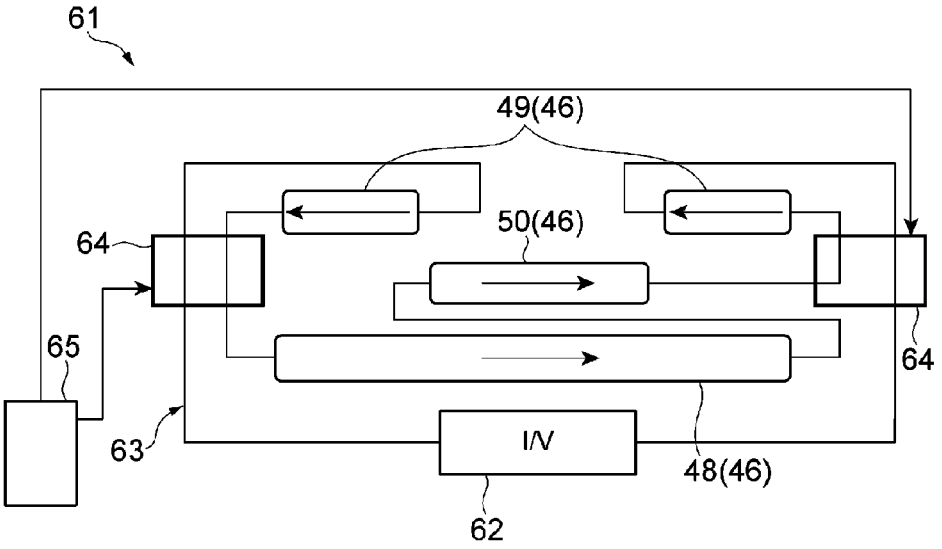
FIGS. 7A and 7B illustrate, respectively, a coil module circuit diagram of a second serial connection type and a temperature distribution of a heating rotor.
Figure 7B:
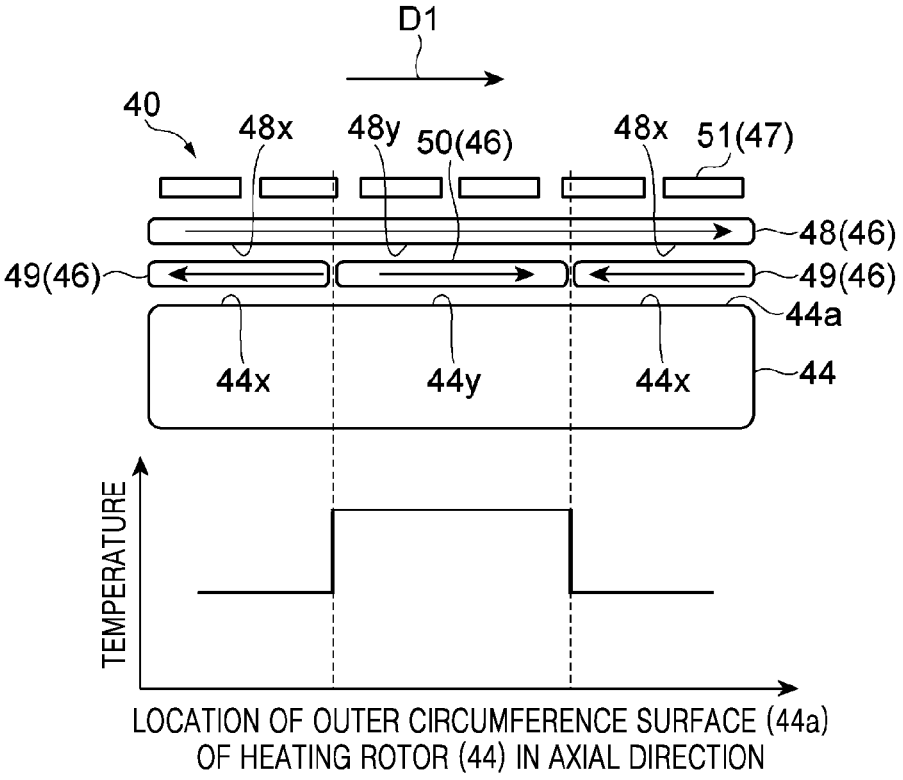

According to the second serial connection type, as illustrated in FIG. 7A, respective coils are connected to each other in series so that the current directions of the first coil 48 and the third coil 50 are different from the current direction of the second coils 49. Since the current direction of the second coils 49 is opposite to the current directions of the first coil 48 and the third coil 50, a portion of the magnetic flux of the first coil 48 is removed by the magnetic flux of the second coils 49. Thus, the magnetic flux density in the outer circumference surface 44*a* of the heating rotor 44 becomes lower in the end portions 44*x* facing the second coils 49 than in other portions. As a result, as illustrated in FIG. 7B, the temperature in the outer circumference surface 44*a* of the heating rotor 44 is lower in the end portions 44*x* than in other portions. The second serial connection type is selected when fed paper has relatively small width. The paper having relatively small width may indicate, for example, paper having a width so that the paper does not contact the end portions 44*x* of the heating rotor 44. Hereinafter, the paper having a relatively small width will be referred to as second paper.

The switching connection unit 64 performs switching to the two serial connection types (the first serial connection type and the second serial connection type) according to a switching signal transmitted from the controller 65. The controller 65 stores set paper (the first paper or second paper) therein and outputs a switching signal according to the set paper to the switching connection unit 64. That is, if the set paper is the first paper, the controller 65 outputs to the switching connection unit 64 a switching signal for selecting the first serial connection type as a serial connection type. If the set paper is the second paper the controller 65 outputs to the switching connection unit 64, a switching signal for selecting the second serial connection type as a serial connection type. Here, the phrase "set paper" refers to a width of the paper that is placed in the transport unit 10.

Also, the fusing device 40 may be adjusted such that a ratio of magnetic fluxes generated by the second coils 49 and the third coil 50 to a magnetic flux generated by the first coil 48 may be less than or equal to 50% (e.g., between 10% and 30%). In detail, at least one of an output power of the power supply 62, characteristics of the second coils 49 and the third coil 50, and characteristics of the core module 47 may be adjusted.

As the output power of the power supply 62 increases, the ratio of the magnetic fluxes generated by the second coils 49 and the third coil 50 to the magnetic flux generated by the first coil 48 (hereinafter, referred to as 'a magnetic flux ratio') is increased. For example, the output power of the power supply 62 may be between about 300 W and about 2000 W. Also, the characteristics of the second coils 49 and the third coil 50 may be a resonance frequency, a material, a diameter, a number of twists, an inner width (or an outer width) in the rotation direction T2, a shape, or the like of the second coils 49 and the third coil 50. As the resonance frequency increases, the magnetic flux ratio decreases. For example, the resonance frequency may be between about 10 kHz and about 100 kHz. In this case, the magnetic flux ratio may be between about 3% and about 50%. With regard to the material, when a material has a high relative permeability, the magnetic flux ratio increases. For example, the material may be Cu, aluminum (Al), or the like. In this case, the magnetic flux ratio may be between about 40% and about 50%. As the diameter (in more detail, a small diameter) increases, the magnetic flux ratio increases. For example, the diameter may be between about 0.08 mm and about 0.8 mm, preferably between about 0.1 mm and about 0.3 mm. In this case, the magnetic flux ratio may be between about 10% and about 50%. As the number of twists increases, the magnetic flux ratio increases. The number of twists may be 1 to about 200 twists, preferably, about 20 twists to about 150 twists. In this case, the magnetic flux ratio may be about 8 to about 50%. As the inner width increases, the magnetic flux ratio decreases. The inner width may be between about 10 mm and about 50 mm, and in this case, the magnetic flux ratio may be about 40 to about 50%. As the outer width increases, the magnetic flux ratio increases. The outer width may be between about 20 mm and about 100 mm, and in this case, the magnetic flux ratio may be about 40 to about 50%. The shape of the second coils 49 and the third coil 50 may be formed by, for example, a twisted shape of a twist line or a method of twisting the twist line. When the twist line has a U shape, the magnetic flux ratio may increase. The twist line may have, for example, a U shape, a c shape, or a semicircular shape. Also, according to the method of twisting the twist line, as twist lines are densely concentrated, the magnetic flux ratio increases. According to the method of twisting the twist line, twist lines may be densely or loosely concentrated.

Also, the characteristics of the core module 47 may particularly be a shape, density, etc. of the core module 47. As the width and thickness of the core module 47 increases, the magnetic flux ratio increases. For example, each core 51 may have a width of about 5 mm to about 30 mm and a thickness of about 1 mm to about 5 mm. A density of the core module 47 is not defined only by an arrangement density of each core 51 and may be defined by a permeability or a saturation magnetic flux density of each core 51. As an arrangement density increases, the magnetic flux ratio increases. As a permeability of each core 51 increases, the magnetic flux ratio increases. For example, the permeability of each core 51 may be between about 1000 H/m to about 3000 H/m. Also, as the saturation magnetic flux density increases, the magnetic flux ratio increases. For example, the saturation magnetic flux density may be between about 300 mT and about 600 mT.

Figure 8A:
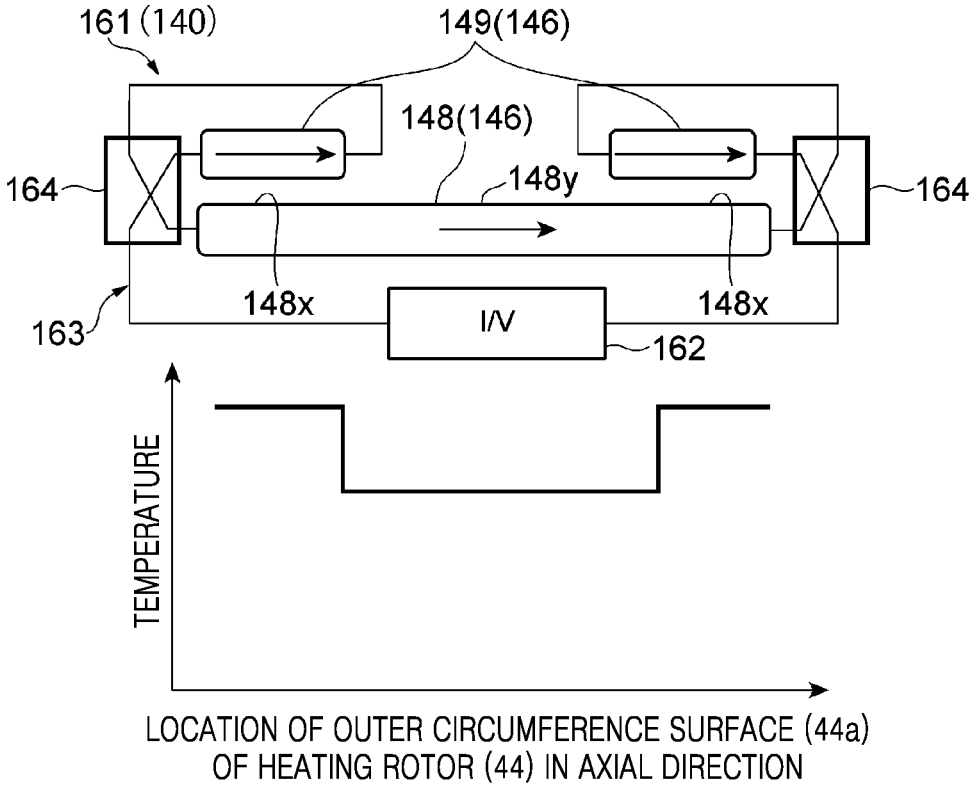
FIGS. 8A and 8B illustrate, respectively, a coil module circuit diagram and a temperature distribution of a heating rotor, according to a comparative example.
Figure 8B:
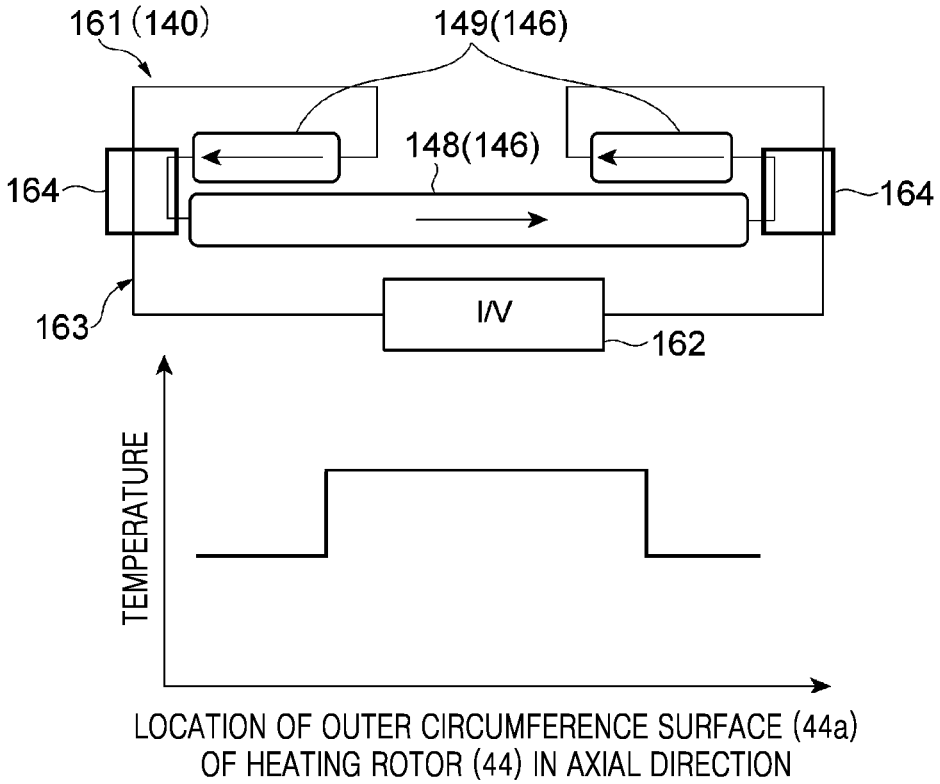

With regard to an effect of the fusing device 40 according to the first exemplary embodiment, the fusing device 40 will be compared with a fusing device 140 according to a comparative example in FIGS. 8A and 8B.

Like the fusing device 40 according to the first exemplary embodiment, the fusing device 140 according to the comparative example includes a coil module circuit 161. The coil module circuit 161 includes a coil module 146, a power supply 162, and a circuit unit 163. Like the coil module 46, the coil module 146 includes a first coil 148 arranged in the axial direction D1, and a pair of second coils 149 arranged to overlap end portions 148*x* of the first coil 148 in the axial direction D1. The coil module 146 does not include a coil (the coil corresponding to the third coil 50 of the fusing device 40) that is arranged to overlap a central portion 148*y* of the first coil 148 in the axial direction D1. The circuit unit 163 includes a switching connection unit 164 configured to switch a serial connection type of each coil so that a current direction of each coil is switched.

In the coil module circuit 161, the switching connection unit 164 may be switched to serial connections of two types. According to a serial connection type, as illustrated in FIG. 8A, respective coils are connected to each other in series so that a current direction of the first coil 148 is the same as a current direction of the second coil 149. The serial connection type is selected when paper has a relatively large width. According to another serial connection type, as illustrated in FIG. 8B, respective coils are connected to each other in series so that the current direction of the first coil 148 is different from the current direction of the second coil 149. Another serial connection type is selected when paper has a relatively small width.

When paper has a relatively small width, the serial connection type of FIG. 8B is selected, and thus a portion of a magnetic flux of the first coil 148 is removed by a magnetic flux of the second coil 149. Accordingly, a magnetic flux density in the outer circumference surface 44*a* of the heating rotor 44 is lower at the end portions 44*x* than in other portions. Thus, when paper having a small width passes through the heating rotor 44, a temperature of a portion (a non-paper feeding portion) of the heating rotor 44 where the paper does not pass through the heating rotor 44 may be prevented from increasing (refer to FIG. 8B).

When the serial connection type of FIG. 8A is selected, a magnetic flux density of the end portions 44*x*, which are portions of the heating rotor 44 face the second coil 149, is higher than a magnetic flux density than a central portion 44*y*. Thus, an increase of a temperature of the heating rotor 44 is greater in the end portions 44*x* than in the central portion 44*y* in the axial direction D1 (refer to FIG. 8A). As a result, when the temperature of the heating rotor 44 is controlled to make the central portion 44*y* of the heating rotor 44 be at a fusing temperature, a temperature of the end portions 44*x* of the heating rotor 44 is relatively increased, and thus, a temperature distribution of the heating rotor 44 becomes non-uniform. When the temperature distribution of the heating rotor 44 is non-uniform, a quality of an image may be affected (e.g., a gloss difference, etc.). Also, as the temperature of the end portions 44*x* of the heating rotor 44 is unnecessarily higher than a fusing temperature, energy (power) may be unnecessarily consumed.

As illustrated in FIGS. 6A and 8B and FIGS. 7A and 7B, in the fusing device 40 according to the first exemplary embodiment, the second coils 49 are installed to overlap the end portions 48*x* of the first coil 48 which face the end portions 44*x* of the heating rotor 44. Also, the third coil 50 is installed to overlap the central portion 48*y* of the first coil 48 which faces the central portion 44*y* of the heating rotor 44. The serial connection type of each coil is switched such that the current directions of respective coils that are connected in series are switched. When the second paper having a relatively small width passes through the heating rotor 44, the second serial connection type (refer to FIGS. 7A and 7B) is selected, and thus the current direction of the second coil 49 is opposite to the current directions of the first coil 48 and the third coil 50. In this case, as described with reference to the comparative example, generation of a magnetic flux in the non-paper feeding portion is restricted, and thus an increase of a temperature of the non-paper feeding portion may be restricted. Also, when the first paper having a relatively large width passes through the heating rotor 44, the first serial connection type (refer to FIGS. 6A and 6B) is selected, and the current directions of the first coil 48, the second coils 49, and the third coil 50 are the same. In this case, a magnetic flux may be generated by the third coil 50 in the central portion 44*y* where the second coils 49 are not installed. Accordingly, a temperature of the end portions 44*x* may not be increased to be higher than a temperature of the central portion 44*y* of the heating rotor 44. As described above, the temperature distribution of the heating rotor 44 may be uniform by using the fusing device 40.

Figure 9:
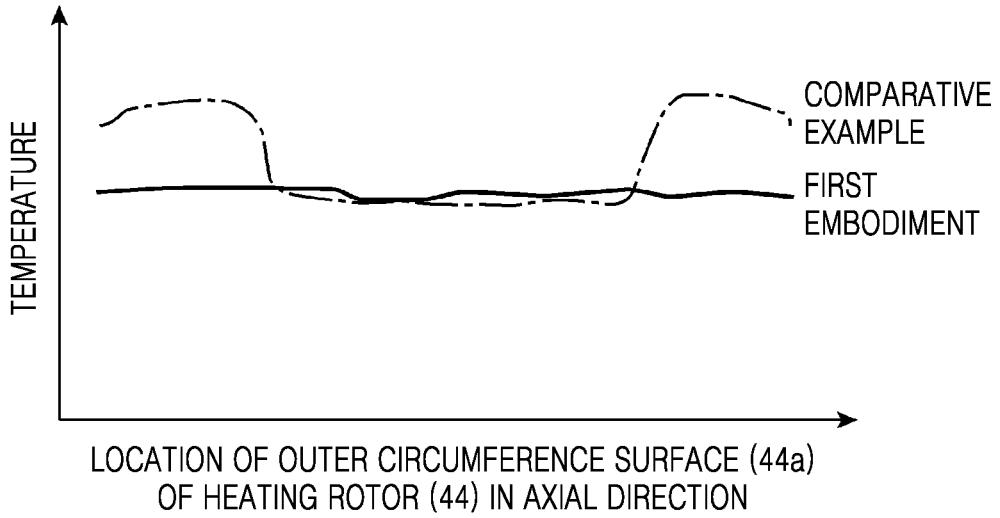
FIG. 9 illustrates a temperature distribution of a heating rotor according to a first exemplary embodiment and a temperature distribution of a heating rotor according to a comparative example.

A gloss difference, etc. of an image may be restricted by making the temperature distribution of the heating rotor 44 be uniform. Also, energy (power consumption) in the fusing device 40 may be reduced. For example, when the second paper is fed to the heating rotor 44, the temperature of the central portion 44*y* of the heating rotor 44 may be maintained at about 150□. In this case, as illustrated in FIG. 9, the temperature of the end portions 44*x* of the heating rotor 44 becomes higher than the temperature of the central portion 44*y* (an alternate long and short dash line of FIG. 9) according to the comparative example. On the other hand, in the fusing device 40, the temperature of the end portions 44*x* of the heating rotor 44 is almost the same as the temperature of the central portion 44*y* (a solid line of FIG. 9). According to the comparative example, as the temperature of the end portions 44*x* increases, power is increasingly consumed (e.g., 780 W). However, since the heating rotor 44 is constantly heated in the fusing device 40, less power may be consumed (e.g., 700 W).

Also, in the fusing device 40, the number of turns of the second coils 49 is less than the number of turns in the first coil 48. In detail, the number of turns of the second coils 49 may be about 10% to about 50% (e.g., 30% or below) of the number of turns in the first coil 48 (e.g., 30% or below). Accordingly, a magnetic flux density in a magnetic field formed by the second coils 49 is decreased, and thus, an increase of the temperature of the end portions 44*x* to be higher than the temperature of the central portion 44*y* may be effectively restricted.

In the fusing device 40, the number of turns of the second coil 49 is less than that of the first coil 48. In detail, the number of turns of the second coil 49 is in a range from about 10% to about 50% (for example, a range from about 10% to about 30%). Accordingly, a magnetic flux density of a magnetic field generated by the second coil 49 decreases, and a temperature rise in the end portions 44*x* may be restricted effectively in comparison with the central portion 44*y*.

Also, inner widths IW1 of the second coils 49 and the third coil 50 of the heating rotor 44 in the rotation direction T1 are greater than an inner width IW2 of the first coil 48 in the rotation direction T1, and outer widths OW1 of the second coils 49 and the third coil 50 of the heating rotor 44 in the rotation direction T1 are smaller than an outer width OW2 of the first coil 48 in the rotation direction T1. That is, the second coils 49 and the third coil 50 are arranged inside the first coil 48 in the rotation direction T1. Accordingly, generation of magnetic fluxes of the second coils 49 and the third coil 50 in a region where a magnetic flux of the first coil 48 does not reach may be prevented, and the temperature distribution of the heating rotor 44 may become uniform.

Also, the second coils 49 and the third coil 50 are at the same distance from the heating rotor 44 in the facing direction D1 and have the same number of turns. Accordingly, the magnetic fluxes generated by the second coils 49 and the third coil 50 may be the same and the temperature distribution of the heating rotor 44 may be more uniform.

Also, in the fusing device 40, at least one of output power of the power supply 162, resonance frequencies, a material, a diameter, an inner or outer width, and a shape of the second coils 49 and the third coil 50, a shape of a core, and a density of a core is adjusted such that a ratio of the magnetic fluxes generated by the second coils 49 and the third coil 50 to the magnetic flux generated by the first coil may be less than or equal to about 50% (e.g., between about 10% and about 30%). An increase of a temperature of a portion of the heating rotor 44, which is caused by an influence of the second coils 49 or the third coil 50, may be restricted by restricting the magnetic flux density of the magnetic fluxes generated by the second coils 49 and the third coil 50, and thus temperature distribution of the heating rotor 44 may be uniform.

Second Exemplary Embodiment

Figure 10:
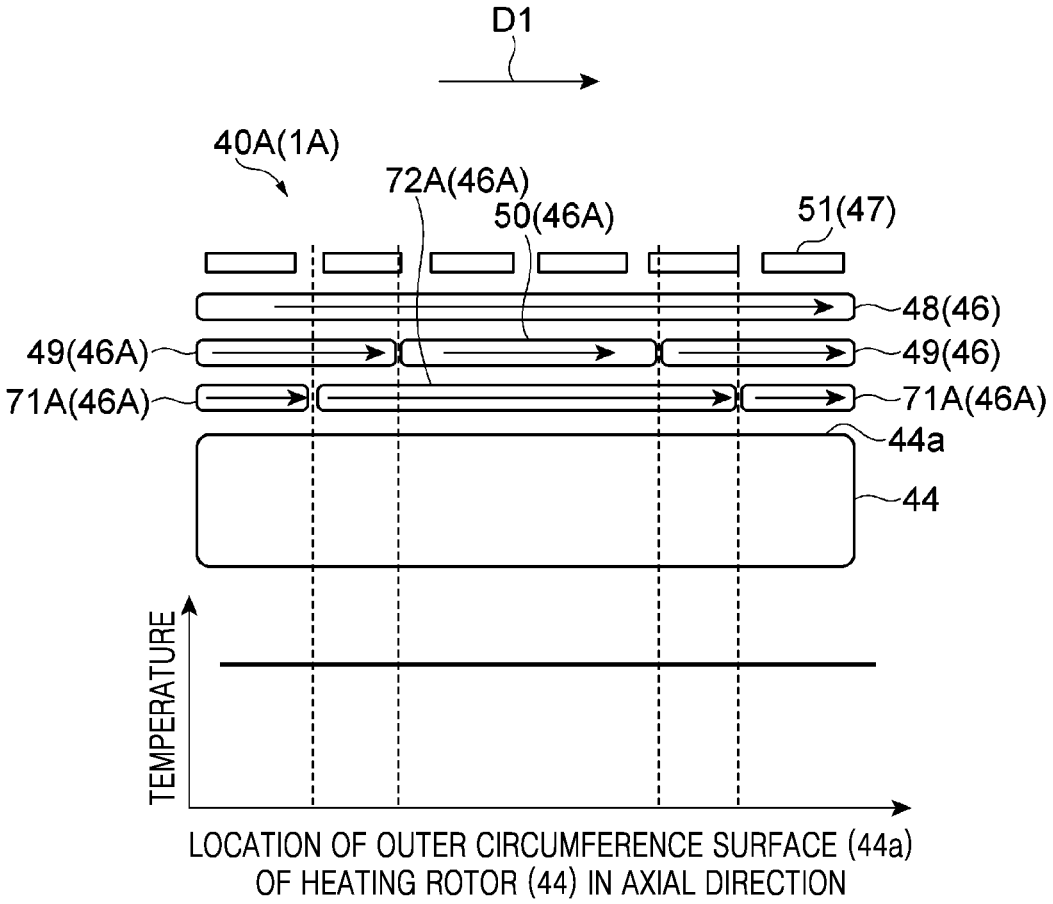
FIG. 10 illustrates a coil structure of a fusing device and a temperature distribution of a heating rotor according to a second exemplary embodiment.

Referring to FIG. 10 in addition of FIGS. 1 to 9, an image forming apparatus 1A according to the second exemplary embodiment will be described. Also, with regard to the following exemplary embodiments, only a difference between the first exemplary embodiment and the following exemplary embodiments will be mainly described and repeated descriptions will be omitted.

The image forming apparatus 1A may include a fusing device 40A. The fusing device 40A may include a coil module 46A. The coil module 46A further includes fourth coils 71A and a fifth coil 72A in addition to each coil (the first coil 48, the second coils 49, and the third coil 50) included in the coil module 46 of the first exemplary embodiment.

The fourth coils 71A are arranged to overlap in the facing direction D2 end portions of the first coil 48 and the second coils 49 in the axial direction D1. The fifth coil 72A is arranged to overlap in the facing direction D2 central portions of the first coil 48 and the third coil 50 in the axial direction D1.

The fourth coils 71A and the fifth coil 72A may have the same distance from the heating rotor 44 in the facing direction D2. A distance between the outer circumference surface 44*a* of the heating rotor 44 and the fourth coils 71A and the fifth coil 72A may be smaller than a distance between the outer circumference surface 44*a* and the second coils 49 and the third coil 50. Also, end portions of the fourth coils 71A and the fifth coil 72A may be adjacent to each other.

A sum of lengths of the fourth coils 71A in the axial direction D1 and a length of the fifth coil 72A in the axial direction D1 may be almost equal to a sum of lengths of the second coils 49 in the axial direction D1 and a length of the third coil 50 in the axial direction D1. Also, a location of one end portion of the fourth coils 71A, which is adjacent to the fifth coil 72A, and a location of another end portion of the fourth coils 71A may be almost the same as a location of one end portion of the second coils 49, which is adjacent to the third coil 50, and a location of another end portion of the second coils 49, respectively. Also, a ratio of lengths of the fourth coils 71A to a length of the fifth coil 72A in the axial direction D1 may be different from a ratio of lengths of the second coils 49 to a length of the third coil 50 in the axial direction D1. In detail, the lengths of the fourth coils 71A in the axial direction D1 may be smaller than the lengths of the second coils 49 in the axial direction D1. Also, the length of the fifth coil 72A in the axial direction D1 may be greater than the length of the third coil 50 in the axial direction D1.

The fourth coils 71A and the fifth coil 72A are connected to the first coil 48, the second coils 49, and the third coil 50 in series by the switching connection unit 64. The switching connection unit 64 switches the serial connection types of the first coil 48, the second coils 49, the third coil 50, the fourth coils 71A, and the fifth coil 72A. Also, current directions of the first coil 48, the third coil 50, and the fifth coil 72A are the same. Also, a current direction of each of the second coils 49 and the fourth coils 71A may be the same as or different from the current direction of the first coil 48.

The fourth coils 71A and the fifth coil 72A are included in the fusing device 40A according to the second exemplary embodiment, and a length ratio of the fourth coils 71A to the fifth coil 72A is different from a length ratio of the second coils 49 to the third coil 50. Accordingly, in comparison with the fusing device 40 according to the first exemplary embodiment, the fusing device 40A responds to a slight difference of paper sizes and may allow the heating rotor 44 to have a uniform temperature distribution.

Figure 11A:
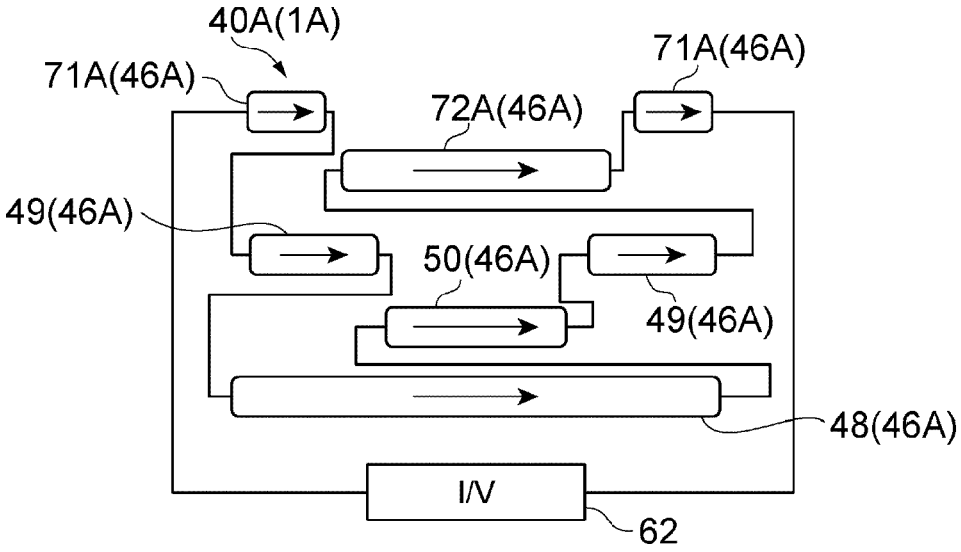
FIGS. 11A-11C illustrate, respectively, a case where paper having a large width is fed to a heating rotor so that the paper almost contacts a portion of the heating rotor that faces fourth coils, a case where paper having a large width is fed to the heating rotor so that the paper contacts a portion of the heating rotor that faces second coils without contacting the portion of the heating rotor that faces the fourth coils, and a case where paper is fed to the heating rotor so that the paper does not contact the portion of the heating rotor that faces the second coils.
Figure 11B:
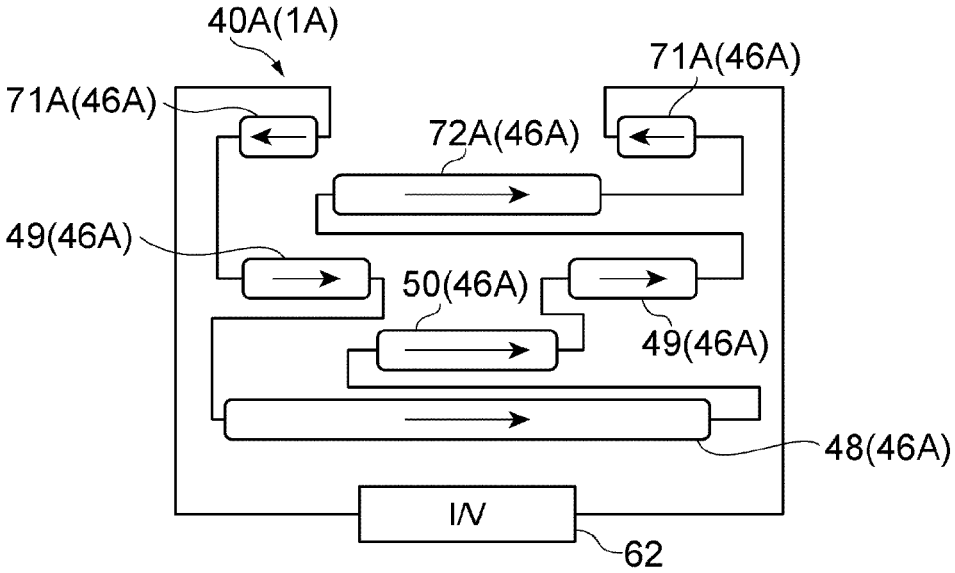
Figure 11C:
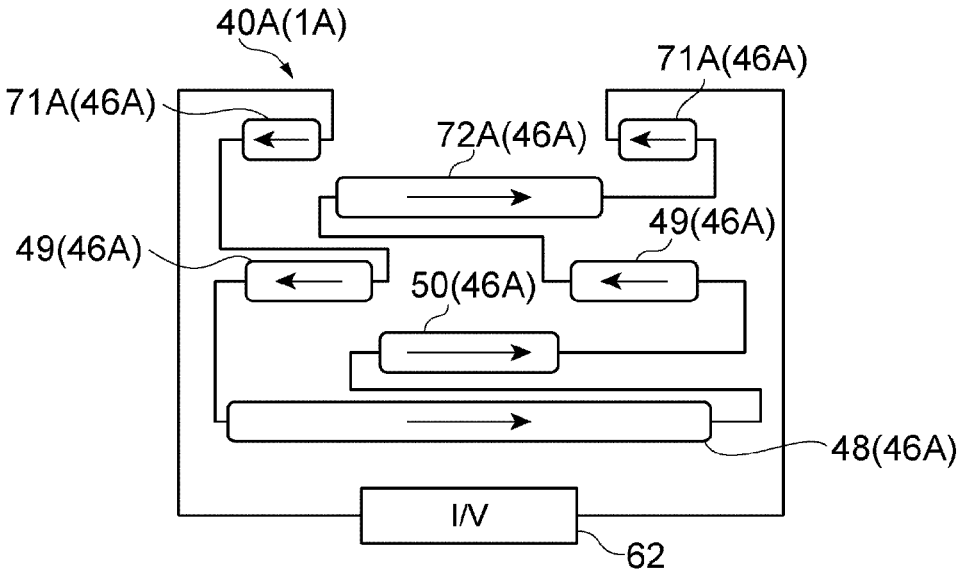

That is, paper having a width so that the paper almost contacts a portion of the heating rotor 44 that faces the fourth coils 71A may be fed to the heating rotor 44. In this case, as illustrated in FIG. 11A, current directions of all coils are the same. Thus, the magnetic flux density may be constant in the axial direction D1 and the temperature distribution of the heating rotor 44 may become uniform. Also, paper having a width so that the paper almost contacts a portion of the heating rotor 44 that faces the second coils 49, even though the paper does not contact the portion of the heating rotor 44 that faces the fourth coils 71A may be fed to the heating rotor 44. In this case, as illustrated in FIG. 11B, the current direction of the fourth coils 71A is different from the current directions of other coils. Accordingly, when the paper is fed to the heating rotor 44, generation of a magnetic flux is restricted in the non-paper feeding portion of the heating rotor 44, and thus, an increase of a temperature in the non-paper feeding portion may be restricted. Also, paper having a width so that the paper does not contact the portion of the heating rotor 44 that faces the second coils 49 may be fed to the heating rotor 44. In this case, as illustrated in FIG. 11C, the current directions of the fourth coils 71A and the second coils 49 may be different from the current directions of other coils. Accordingly, when the paper is fed to the heating rotor 44, the generation of a magnetic flux is restricted in the non-paper feeding portion of the heating rotor 44, and thus, an increase of a temperature in the non-paper feeding portion may be restricted. It should be noted that in FIGS. 11A-11C, some components of the fusing device 40A are omitted for clarity.

At least one of output power of the power supply 62, characteristics of the fourth coils 71A and the fifth coil 72A, and characteristics of the core module 47 may be adjusted such that a magnetic flux ratio of the magnetic fluxes generated by the fourth coils 71A and the fifth coil 72A to the magnetic flux generated by the first coil 48 may be less than or equal to about 50% (e.g., between about 10% and about 30%) in the fusing device 40A. Descriptions of the output power of the power supply 62 and the conditions of the core module 47 are the same as described in the first exemplary embodiment.

In detail, the characteristics of the fourth coils 71A and the fifth coil 72A may be a resonance frequency, a material, a diameter, a number of twists, an inner width (or an outer width) in the rotation direction T1, a shape, or the like of the fourth coils 71A and the fifth coil 72A. The resonance frequency may be between about 10 kHz and about 100 kHz. The material may be Cu, Al, or the like. The diameter (in more detail, a small diameter) may be between about 0.08 mm and about 0.8 mm (e.g., between about 0.1 mm and about 0.3 mm). The number of twists may be 1 to about 200 twists (e.g., about 20 twists to about 150 twists). The inner width may be, for example, between about 10 mm and about 50 mm. The outer width may be, for example, between about 20 mm and about 100 mm. The shape of the fourth coils 71A and the fifth coil 72A may be formed by, for example, a twisted shape of a twist line or a method of twisting the twist line. When the twist line has a U shape, the magnetic flux ratio may increase. The twist line may have, for example, a U shape, a c shape, or a semicircular shape. Also, according to the method of twisting the twist line, as twist lines are densely concentrated, the magnetic flux ratio increases. According to the method of twisting the twist line, twist lines may be densely or loosely concentrated.

Third Exemplary Embodiment

Referring to FIGS. 12A to 16 in addition to FIGS. 1 to 11C, an image forming apparatus 1B according to the third exemplary embodiment will be described.

Figure 12A:
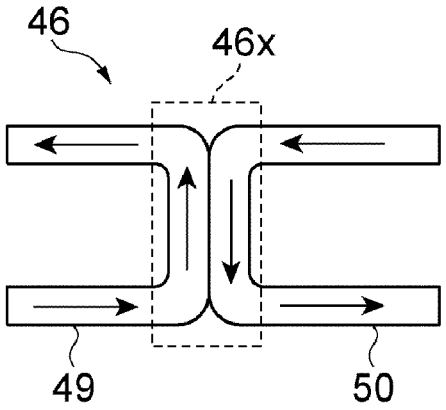
FIGS. 12A-12C illustrate, respectively, current flows in a coil in a connection region according to a third exemplary embodiment, a case where a current flows in a coil in a connection region according to a fourth exemplary embodiment, and a case where a current flows in a coil in a connection region according to a fifth exemplary embodiment.
Figure 13A:
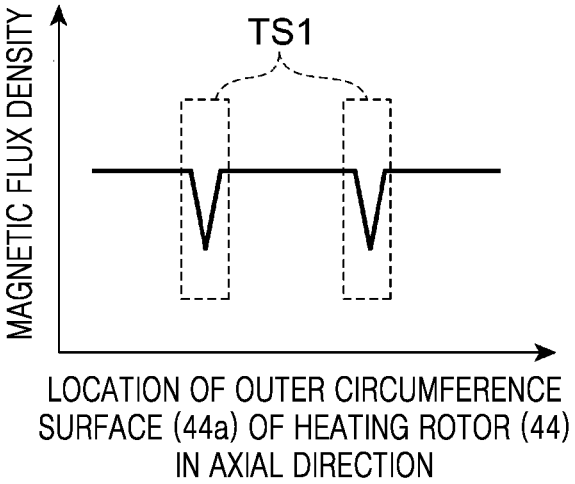
FIGS. 13A and 13B illustrate, respectively, a magnetic flux distribution of a heating rotor according to the third exemplary embodiment and a magnetic flux distribution of a heating rotor according to the fourth exemplary embodiment.

Like in the first exemplary embodiment, the coil module 46 of the third exemplary embodiment illustrated in FIG. 12A may include the second coils 49 and the third coil 50. Circular arc portions 46*c* of the second coils 49 and the third coil 50 are arranged adjacent to the connection region 46*x*. In this case, there is no space between coils, and thus the temperature distribution of the heating rotor 44 may easily remain uniform in comparison with coils having a large space therebetween. However, for example, when currents flow in the second coils 49 and the third coil 50 in the same direction, a current direction of the second coils 49 is opposite to a current direction of the third coil 50 in the connection region 46*x*, and thus the magnetic flux of each of the second coils 49 and the third coil 50 is removed. Therefore, as illustrated in FIG. 13A, the magnetic flux density may be lower in the region TS1 of the heating rotor 44 which faces the connection region 46*x* than in other regions of the heating rotor 44. As a result, the temperature distribution of the heating rotor 44 may become non-uniform.

Figure 14:
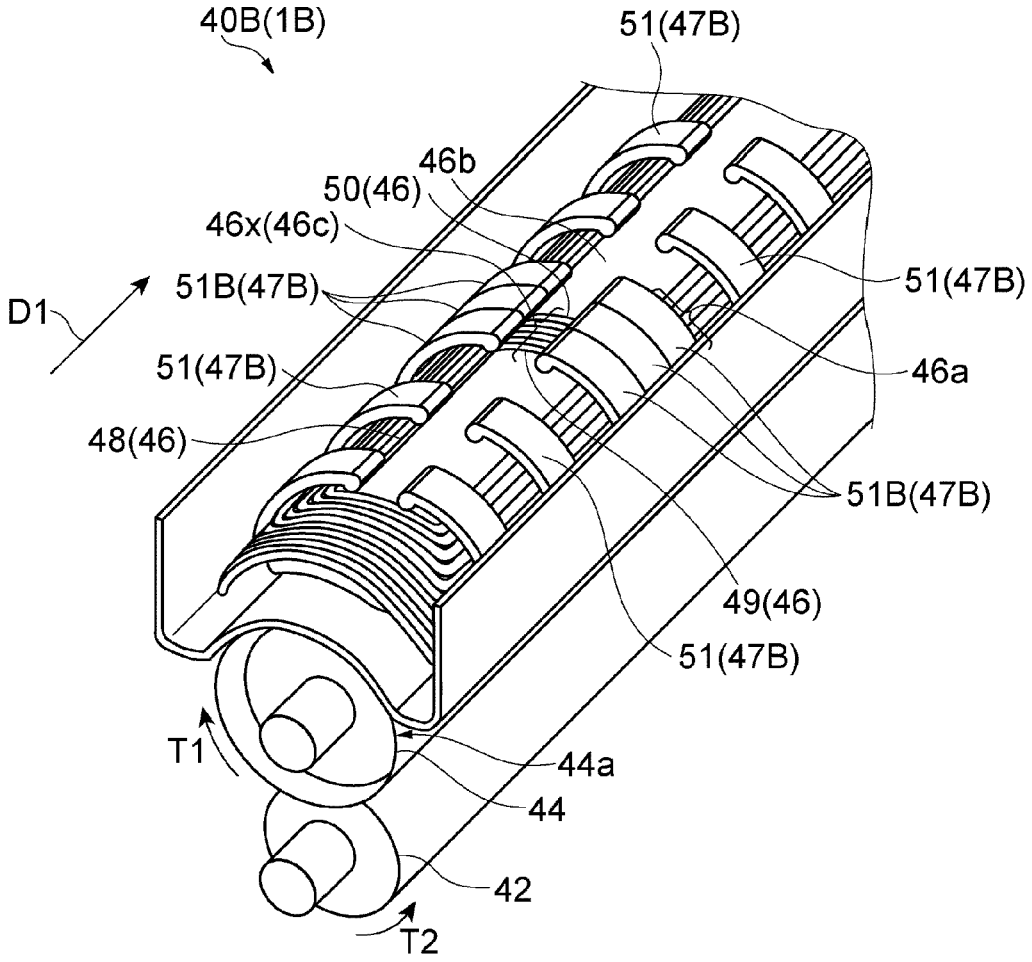
FIG. 14 illustrates a perspective view of a fusing device according to the third exemplary embodiment.
Figure 15:
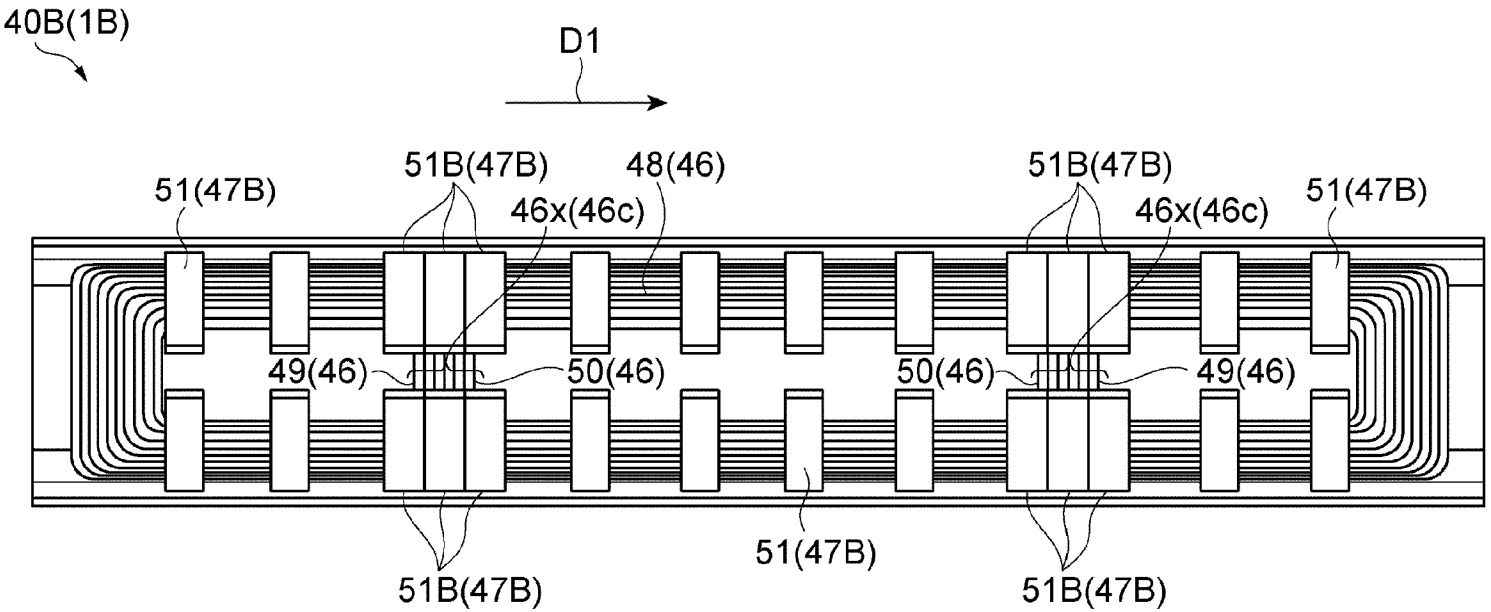
FIG. 15 illustrates a plan view of a coil and a core of the fusing device of FIG. 14.
Figure 16:
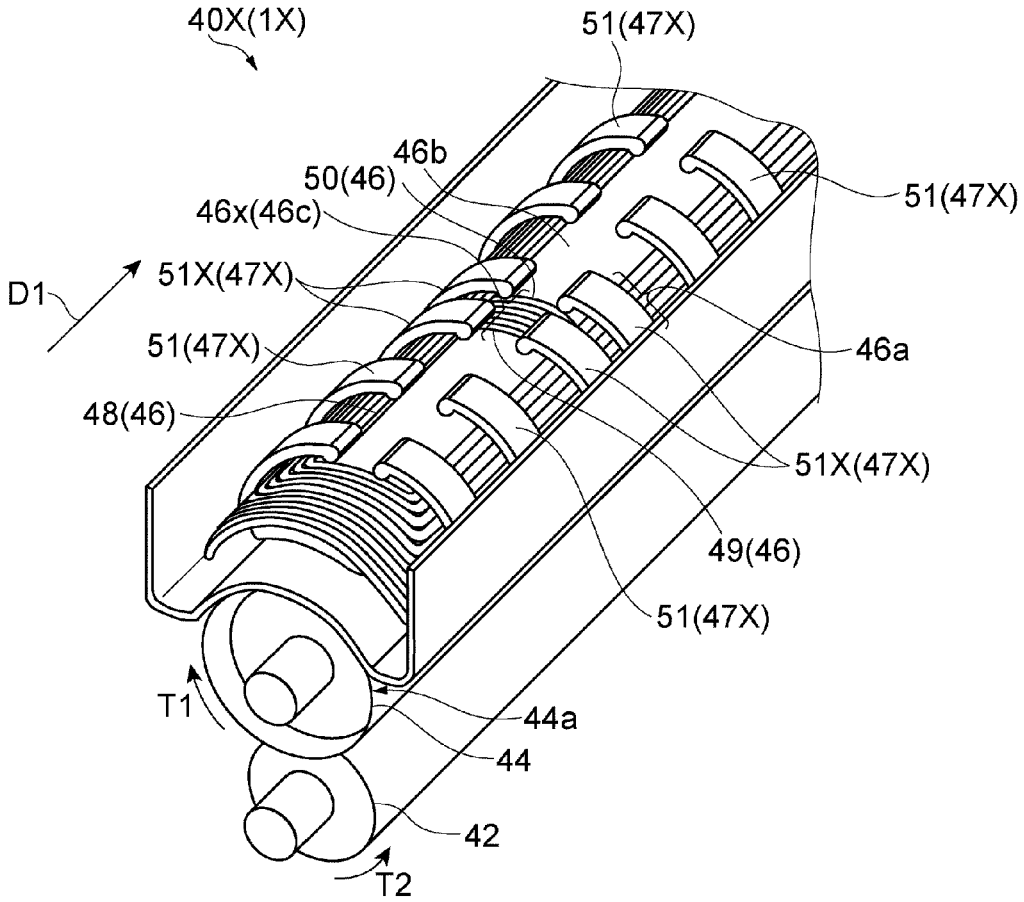
FIG. 16 illustrates a perspective view of a fusing device according to a modified example.

As illustrated in FIGS. 14 and 15, the image forming apparatus 1B according to the third exemplary embodiment may include a fusing device 40B. The fusing device 40B may include a core module 47B.

The core module 47B may include a plurality of cores 51B (connection portions) overlapping the connection region 46*x* in the facing direction D2. Also, the core module 47B may include a plurality of cores 51 (main portions) other than the cores 51B. The cores 51 are arranged in a region, except for a region facing the connection region 46*x* (a region where the cores 51B are installed), in parallel at regular intervals in the axial direction D1. The cores 51B and 51 may have the same permeability.

The cores 51B and 51 have different arrangement densities in the axial direction D1. That is, the cores 51 are arranged at regular intervals, but the cores 51B are arranged in a vicinity of (in contact with) each other. Thus, the cores 51B may have a higher arrangement density than the cores 51 in the axial direction D1.

As described above, the magnetic fluxes generated by the second coils 49 and the third coil 50 may affect each other in the connection region 46*x*. Accordingly, the region TS1 (FIG. 13A) of the heating rotor 44 which faces the connection region 46*x* may have a magnetic field different from that of other regions of the heating rotor 44.

Figure 13B:
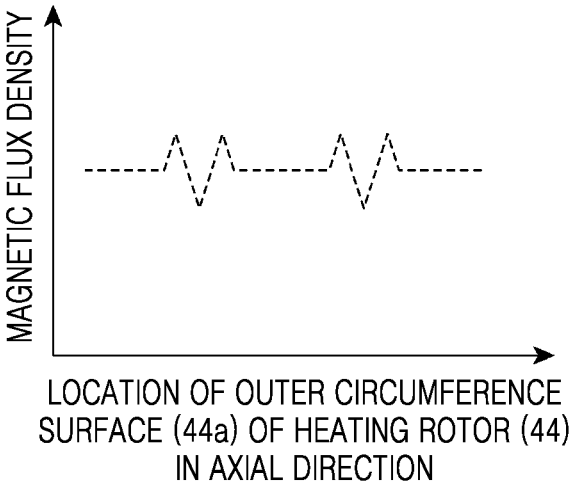

In the third exemplary embodiment, an arrangement density of the cores 51B overlapping the connection region 46*x* in the facing direction D2 is higher than an arrangement density of the cores 51. Accordingly, as illustrated in FIG. 13B, the magnetic flux density of the region adjacent to the region TS1 of the heating rotor 44 that has a decreased magnetic flux density may be increased. As a result, the temperature distribution of the heating rotor 44 in the axial direction D1 may be uniform.

Also, a feature that the temperature distribution of the heating rotor 44 is made uniform by adjusting the magnetic flux density of the region adjacent to the region of the heating rotor 44 that has the low magnetic flux density is not the only feature of the fusing device 40B. For example, like the fusing device 40X of the image forming apparatus 1X illustrated in FIG. 16, the core module 47X may include cores 51X overlapping the connection region 46*x* in the facing direction D2 and cores 51 that are cores other than the cores 51X. The cores 51X and 51 may have the same arrangement density and permeability. The cores 51X and 51 are at different distances from the heating rotor 44 in the facing direction D2. In detail, the cores 51X are at a smaller distance from the heating rotor 44 than the cores 51. Accordingly, the magnetic flux density of the region adjacent to the region of the heating rotor 44 that has the decreased magnetic flux density (the region TS1 facing the connection region 46*x*) may be increased. As a result, the temperature distribution of the heating rotor 44 in the axial direction D1 may be uniform.

Each core of the core module has the same arrangement density and the same distance from the heating rotor 44, but a permeability of the cores which overlap the connection region 46*x* in the facing direction D2 may be different from that of other cores. In detail, the permeability of the cores which overlap the connection region 46*x* in the facing direction D2 may be greater than the permeability of other cores. Accordingly, the magnetic flux density of the region adjacent to the region of the heating rotor 44 that has the decreased magnetic flux density (the region TS1 facing the connection region 46*x*) may be increased. As a result, the temperature distribution of the heating rotor 44 in the axial direction D1 may be uniform.

Figure 18A:
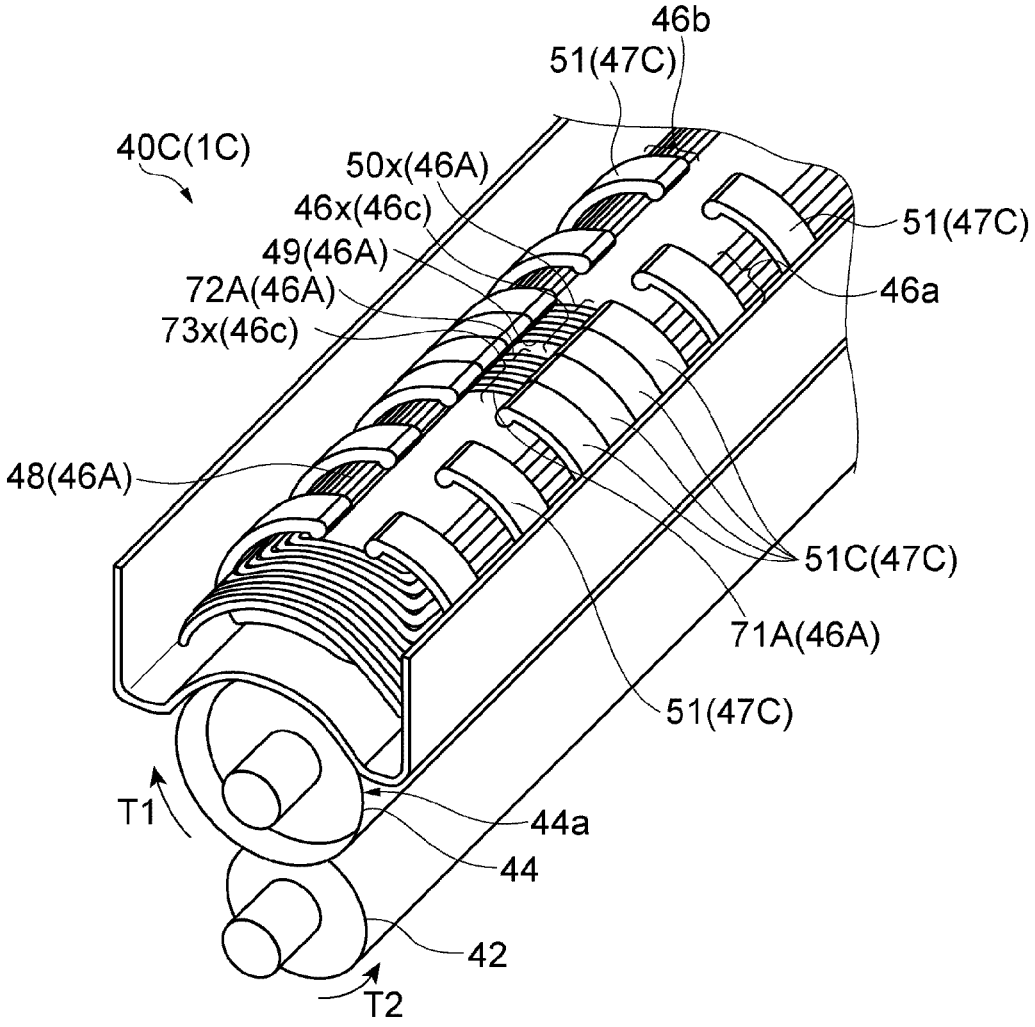
FIGS. 18A and 18B illustrate, respectively, a perspective view of a fusing device according to a modified example and a plan view of a coil and a core.
Figure 18B:
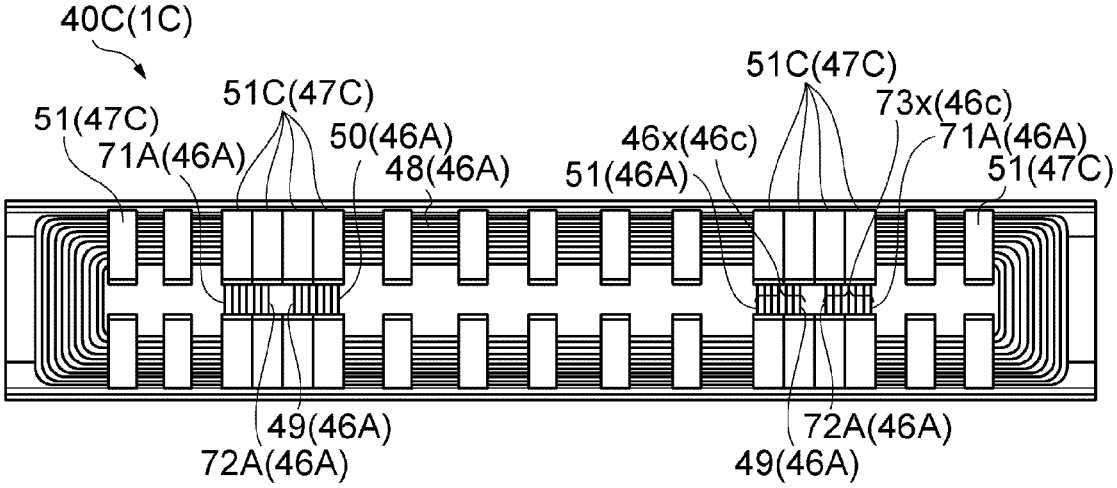

Also, like the fusing device 40A of the second exemplary embodiment, a fusing device 40C (an image forming apparatus 1C) may include the fourth coils 71A and the fifth coil 72A, and the fourth coils 71A and the fifth coil 72A forms a connection region 73*x* that has the same relationship as the connection region 46*x* formed by the second coils 49 and the third coil 50 (refer to FIGS. 18A and 18B). The fusing device 40C includes a core module 47C. The core module 47C includes cores 51C (connection portions) overlapping the connection region 46*x* and the connection region 73*x* in the facing direction D2. Also, the core module 47C includes cores 51 (main portions) other than the cores 51C. The cores 51 are arranged in parallel at regular intervals in the axial direction D1, other than a region where the cores 51C are installed. The cores 51C and 51 have the same permeability.

The cores 51C and 51 have different arrangement densities in the axial direction D1. That is, the cores 51 are arranged at regular intervals, but the cores 51C are arranged in a vicinity of (in contact with) each other. Thus, the cores 51C have a higher arrangement density than the cores 51 in the axial direction D1.

The arrangement density of the cores 51C overlapping the connection region 46*x* and the connection region 73*x* in the facing direction D2 is higher than the arrangement density of the cores 51 that are other cores other than the cores 51C. Accordingly, a magnetic flux density of a region adjacent to a region of the heating rotor 44 that has a decreased magnetic flux density (a region facing the connection region 46*x* and the connection region 73*x*) may be increased. As a result, the temperature distribution of the heating rotor 44 in the axial direction D1 may be uniform.

Fourth Exemplary Embodiment

Like the third exemplary embodiment, the fourth exemplary embodiment will be described with reference to FIGS. 1 to 16.

Figure 12B:
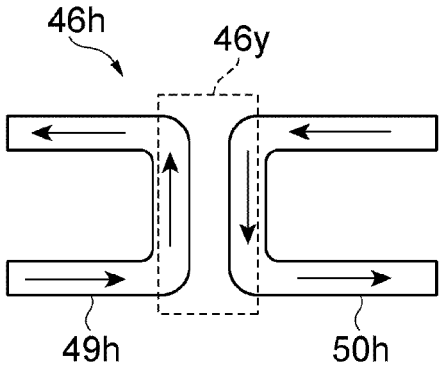

In the third exemplary embodiment, the end portions of the second coils 49 and the third coil 50 of the coil module 46 are arranged adjacent to each other in the connection region 46*x*. According to the fourth exemplary embodiment, as illustrated in FIG. 12B, end portions of a second coil 49*h* and a third coil 50*h* of a coil module 46*h* are separated from each other in a connection region 46*y*. As the end portions are separated from each other, the second coil 49*h* and the third coil 50*h* may be easily arranged.

When the second coil 49*h* and the third coil 50*h* are separated from each other, an offset of magnetic flux, which is described in the third exemplary embodiment, may not be formed even though currents flow in the second coil 49*h* and the third coil 50*h* in the same direction. However, coils do not exist in a portion of the connection region 46*y* and no magnetic flux is generated in this portion. Accordingly, as illustrated in FIG. 13A, a region TS1 of the heating rotor 44 which faces the connection region 46*y* may have a lower magnetic flux density than in other regions of the heating rotor 44. As a result, a temperature distribution of the heating rotor 44 may become non-uniform. Although the temperature distribution of the heating rotor 44 is non-uniform, a magnetic flux density of a region adjacent to a region of the heating rotor 44 that has a decreased magnetic flux density (the region TS1 facing the connection region 46*y*) may be increased (FIG. 13B) by applying core structures of the fusing device 40B (refer to FIGS. 14 and 15) or the fusing device 40X (refer to FIG. 16) described in the third exemplary embodiment. As a result, a temperature distribution of the heating rotor 44 in the axial direction D1 may be uniform.

Also, like in the fusing device 40A of the second exemplary embodiment, a case, where the fourth coils 71A and the fifth coil 72A may form a connection region that is the same as the connection region 46*y* formed by the second coil 49*h* and the third coil 50*h*, may be considered. In this case, the core module of the fusing device 40B (refer to FIGS. 14 and 15) or the fusing device 40X (refer to FIG. 16) may be applied to increase a magnetic flux density of a region that is adjacent to a region of the heating rotor 44 that faces the connection region formed by the fourth and fifth coils, and thus, a temperature distribution of the heating rotor 44 in the axial direction D1 may be uniform.

Fifth Exemplary Embodiment

Figure 17A:
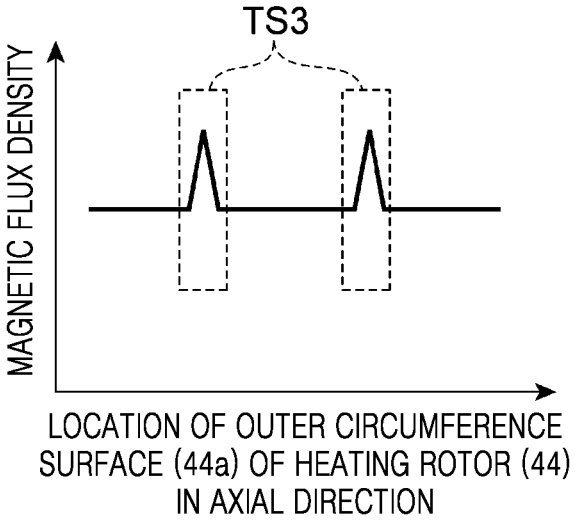
FIGS. 17A and 17B illustrate a magnetic flux distribution of a heating rotor according to a fifth exemplary embodiment.
Figure 17B:
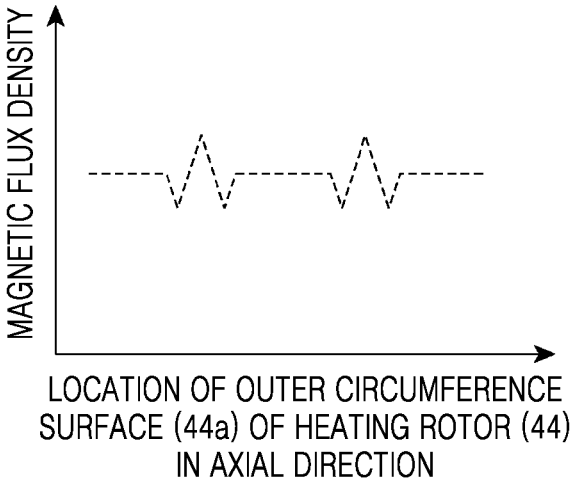

Referring to FIGS. 17A and 17B in addition to FIGS. 1 to 16, a fifth exemplary embodiment will be described.

Figure 12C:
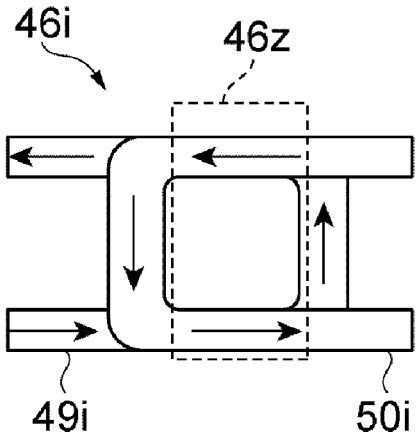

According to the above-described third exemplary embodiment, the end portions of the second coils 49 and third coils 50 of the coil module 46 are arranged adjacent to the connection region 46*x*. In this regard, according to the fifth embodiment, end portions of a second coil 49*i* and third coil 50*i* of a coil module 46*i* overlap each other in the facing direction D2, as illustrated in FIG. 12C. In this case, when a current flows in the second coil 49*i* and the third coil 50*i* in the same direction, a current flows in a connection region 46*z* as well in the same direction as the above direction. Thus, magnetic fluxes generated by coils constructively interfere with each other.

In this case, as illustrated in FIG. 17A, a region TS2 of the heating rotor 44 which faces the connection region 46*z* may have an increased magnetic flux in comparison with other regions of the heating rotor 44. As a result, a temperature distribution of the heating rotor 44 may not be uniform.

Contrary to the third exemplary embodiment in which a magnetic flux density of a region adjacent to a region where a magnetic flux density is decreased is increased, a magnetic flux of a region adjacent to a region where a magnetic flux density is increased is decreased in the fifth exemplary embodiment. That is, for example, an arrangement density of multiple cores overlapping the connection region 46*z* in the facing direction D2 may be lower than an arrangement density of other cores. Also, for example, a distance between the heating rotor 44 and the cores overlapping the connection region 46*z* in the facing direction D2 may be greater than a distance between the heating rotor 44 and the other cores. Also, for example, magnetic permeability of the cores overlapping the connection region 46*z* in the facing direction D2 may be lower than that of the other cores. Accordingly, as illustrated in FIG. 17B, a magnetic flux density of a region adjacent to a region TS3 where a magnetic flux density of the heating rotor 44 is increased may be decreased. As a result, a temperature distribution of the heating rotor 44? in the axial direction D1 may be uniform.

Like the fusing device 40A according to the second exemplary embodiment, a fusing device includes a fourth coil and a fifth coil, and the fourth coil and the fifth coil may form a connection region that is the same as the connection region 46*z* formed by the second coil 49*i* and the third coil 50*i*. In this case, a core module is formed such that a magnetic flux density of a region adjacent to a region of the heating rotor 44 which faces the connection region formed by the fourth and fifth coils is decreased. Thus, a temperature distribution of the heating rotor 44 in the axial direction D1 may be uniform.

Sixth Exemplary Embodiment

Referring to FIGS. 19A to 22 in addition to FIGS. 1 to 18B, an image forming apparatus 1D according to the sixth exemplary embodiment will be described.

As illustrated in FIGS. 19A to 19D, the image forming apparatus 1D may include a fusing device 40D. Also, FIGS. 19A to 19D only illustrate components regarding the coil module 46 from among components of the fusing device 40D, and the other components will be omitted for clarity of description.

The controller 65 (of FIGS. 7A and 7B) of the fusing device 40D controls at least one of the power supply 62 and the switching connection unit 64. The controller 65 respectively sets control patterns of the at least one of the power supply 62 and the switching connection unit 64 according to a paper feeding state.

Figure 19A:
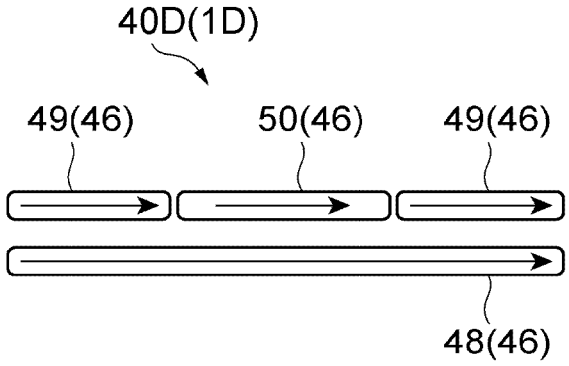
FIGS. 19A to 19D illustrate, respectively, a current flowing in a coil of a fusing device according to a sixth exemplary embodiment.
Figure 19B:
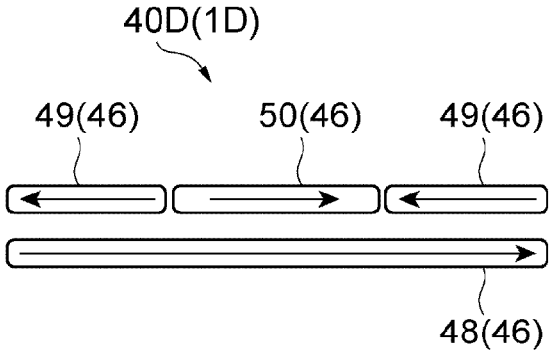
Figure 19C:
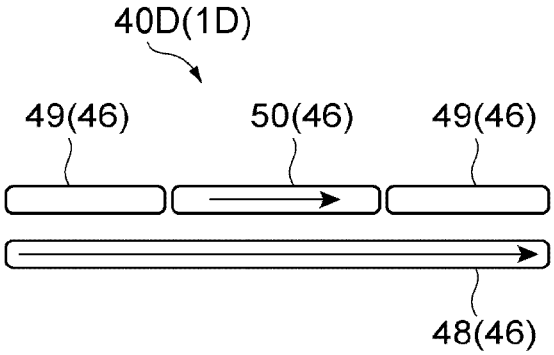
Figure 19D:
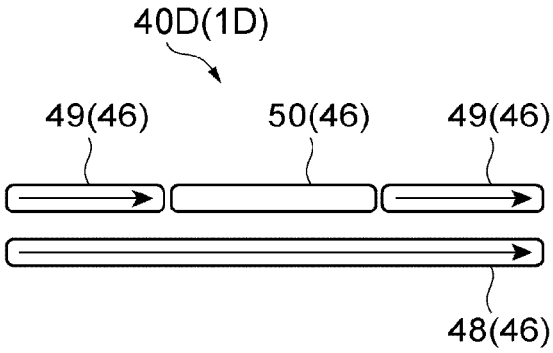

As described above, the controller 65 controls the switching connection unit 64 by outputting a switching signal for the switching connection unit 64 such that the switching connection unit 64 may be switched to form serial connection of two types (a first serial connection type and a second serial connection type). According to the first serial connection type, as illustrated in FIG. 19A, respective coils are connected to each other in series so that current directions of the first coil 48 and the third coil 50 are the same as a current direction of the second coils 49. Also, according to the second serial connection type, as illustrated in FIG. 19B, respective coils are connected in series so that the current directions of the first coil 48 and the third coil 50 are opposite to the current direction of the second coils 49. As described above, the current directions of the first coil 48 and the third coil 50 are the same. The aforementioned serial connection types are examples of control patterns configured to control the switching connection unit 64.

Also, the controller 65 may set a control pattern, which is different from the control patterns according to the above serial connection types, by controlling power supplied by the power supply 62. That is, based on the control patterns according to the serial connection types, power is supplied to all coils, but there may be a control pattern in which power is not supplied to some coils (a pattern in which power supply by the power supply 62 is halted). For example, a control pattern (FIG. 19C) in which power is not supplied to the second coils 49 and a control pattern (FIG. 19D) in which power is not supplied to the third coil 50 may also exist.

Figure 20:
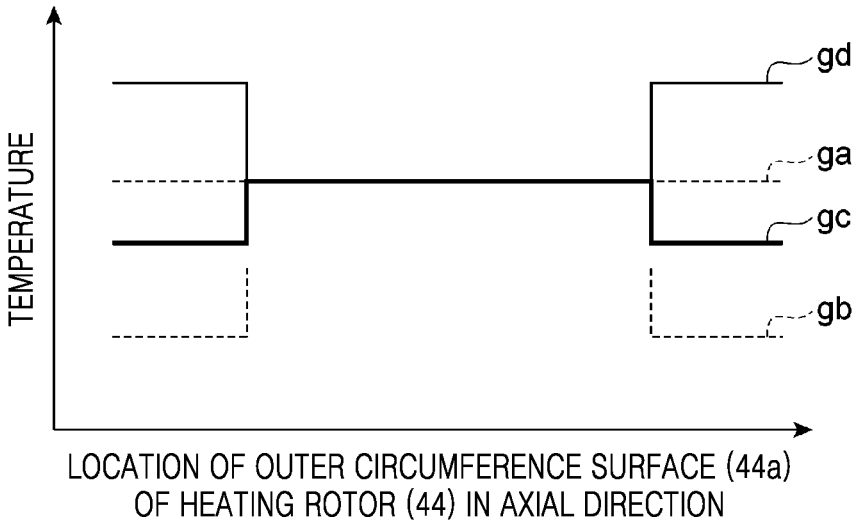
FIG. 20 illustrates a temperature distribution of a heating rotor when a current flows as illustrated in FIGS. 19A to 19D.

Since various types of control patterns may be set, temperature distributions may vary based on the axial direction D1. That is, as shown in FIG. 20, in addition to a temperature distribution ga and temperature distribution gb according to the control patterns of the above serial connection types, a temperature distribution gc according to the control pattern, in which power is not supplied to the second coils 49, and a temperature distribution gd according to the control pattern, in which power is not supplied to the third coil 50, may be implemented. Accordingly, the temperature distribution of the heating rotor 44 uniform may be made according to various situations.

Also, a method of controlling, by the controller 65, power supplied by the power supply 62 is not limited to a certain method. For example, a method of controlling whether to supply power to each coil by preparing a bypass in parallel with respective coils included in a serial connection circuit and selecting a coil or the bypass using a switch controlled by the controller 65 may be used.

Figure 21A:
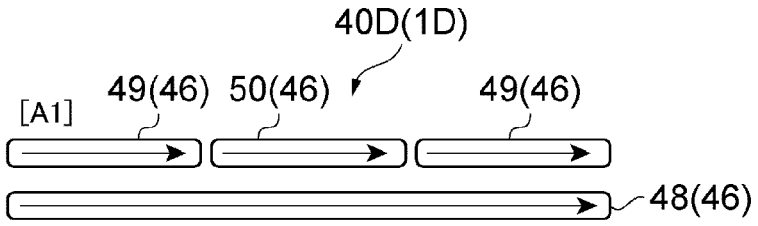
FIG. 21A to 21G illustrate control patterns.
Figure 21B:
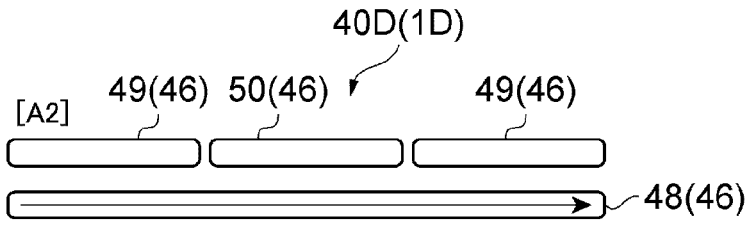
Figure 21C:
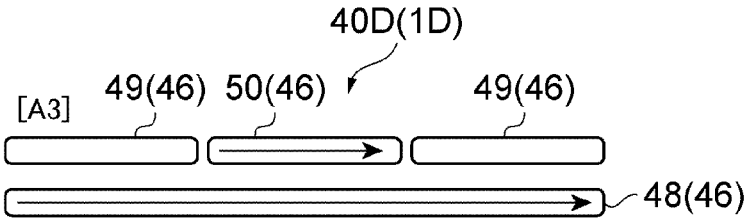
Figure 21D:
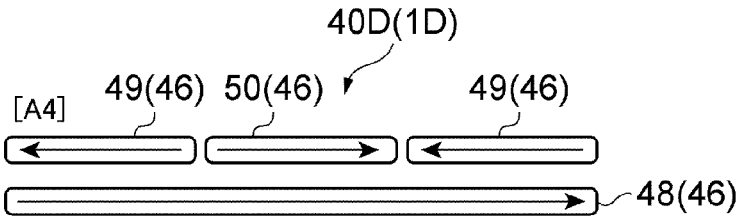
Figure 21E:
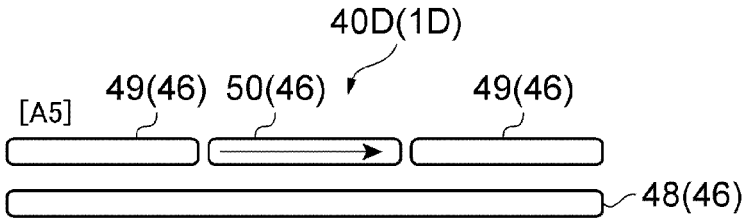
Figure 21F:
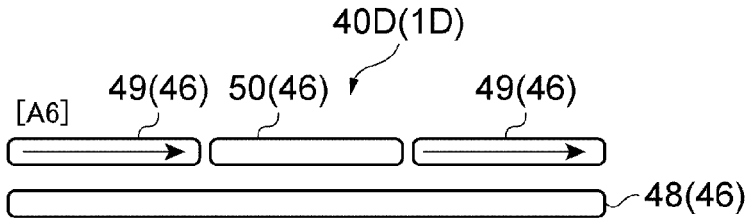
Figure 21G:
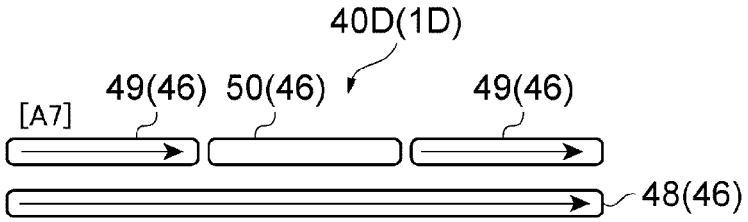

Various control patterns are illustrated in FIGS. 21A to 21F. FIGS. 21A to 21F illustrate control patters A1 to A7, respectively. In the control pattern A1, power is supplied to all coils at a point in time when the first serial connection type that is one of serial connection types is selected (FIG. 21A). In the control pattern A2, power is supplied to the first coil 48 at a point in time when the first serial connection type (or the second serial connection type) that is one of serial connection types is selected (FIG. 21B). In the control pattern A3, power is supplied to the first coil 48 and the third coil 50 at a point in time when the first serial connection type (or the second serial connection type) that is one of serial connection types is selected (FIG. 21C). In the control pattern A4, power is supplied to all coils at a point in time when the second serial connection type that is one of serial connection types is selected (FIG. 21D). In the control pattern A5, power is supplied to the third coil 50 at a point in time when the first serial connection type (or the second serial connection type) that is one of serial connection types is selected (FIG. 21E). In the control pattern A6, power is supplied to the second coils 49 at a point in time when the first serial connection type that is one of serial connection types is selected (FIG. 21F). In the control pattern A7, power is supplied to the first coil 48 and the second coils 49 at a point in time when the first serial connection type that is one of serial connection types is selected (FIG. 21G).

Setting examples of the control patterns are illustrated in FIG. 22. FIG. 22 illustrates appropriate control patterns according to conditions including a paper type, a paper width, a paper feeding state, and a non-paper feeding state. The paper type indicates whether the paper is regular or thick. The regular paper is paper having a base weight of from about 60.2 to about 104.7 g/m$^2$, and the thick paper is paper having a base weight of from about 104.7 to about 216.0 g/m$^2$. The paper feeding state indicates a state in which paper passes through the fusing device and may further include states in which paper starts being fed to the fusing device, multiple sheets of paper are being continuously fed to the fusing device, and paper feeding is terminated. Also, the non-paper feeding state indicates that paper feeding is prepared. In the paper feeding state, the following conditions may be used to determine control patterns: whether a temperature of the heating rotor 44 is a target temperature (a target temperature of the heating rotor 44)+3□ or above, or the target temperature ±3□, or the target temperature −3□ or below. Also, in the non-paper feeding state, a control pattern is set when the heating rotor 44 has a temperature lower than the target temperature. When the heating rotor 44 has a temperature higher than the target temperature, a control pattern is not set (does not change). The target temperature may be predetermined or determined experimentally and set. An example of setting a control pattern illustrated in FIG. 22 shows that a length of the first coil 48 in the axial direction D1 is about 300 mm, and respective lengths of the second coils 49 and the third coil 50 in the axial direction D1 are about 100 mm.

For example, when the paper is regular paper, has a width ranging from about 151 to about 200 mm, and is in the paper feeding state, and when a temperature of the heating rotor 44 is equal to or higher than a target temperature +3□, a control pattern A5 (FIG. 21E) is selected. Also, when paper is regular paper, has a width ranging from about 101 to about 150 mm and is the paper feeding state, and when the temperature of the heating rotor 44 is equal to or higher than a target temperature +3□, a control pattern OFF is selected. The control pattern OFF indicates that a control pattern is not newly set.

The above descriptions about setting of the control patterns, and conditions used to determine a control pattern are also merely examples. For example, it has been described that the conditions includes the paper feeding state and the non-paper feeding state, but in more detail, states in which paper is prepared, paper starts being fed, multiple sheets of paper are being continuously fed, and paper feeding is terminated may respectively be the conditions. Since control patterns are determined according to a paper feeding status, it is possible to restrict power supply when paper is not fed in comparison with power supply during paper feeding, and thus, a temperature distribution of the heating element 44 may be uniform according to various situations.

Since control patterns are determined according to various paper widths as illustrated in FIG. 22, the temperature distribution of the heating element 44 may be uniform by selecting appropriate control patterns according to various paper widths and may be uniform when sheets of paper having various widths are fed.

Since control patterns are determined according to a thickness of paper, the temperature distribution of the heating element 44 may be uniform by selecting appropriate control patterns according to various paper thicknesses and may be uniform when sheets of paper having various thicknesses are fed.

Also, since control patterns are determined according to a difference between a measured temperature and a target temperature of the heating rotor 44, appropriate control patterns may be selected according to temperature conditions of the heating rotor 44.

Seventh Exemplary Embodiment

Referring to FIGS. 23A to 25 in addition to FIGS. 1 to 22, an image forming apparatus 1E according to the seventh exemplary embodiment will be described.

As illustrated in FIGS. 23A to 23F and 24A to 24F, the image forming apparatus 1E may include a fusing device 40E. The fusing device 40E may include the coil module 46A like the fusing device 40 according to the second exemplary embodiment (refer to FIGS. 10 and 11A-11C). FIGS. 23A to 23F and 24A to 24F only illustrate components regarding the coil module 46A from among components of the fusing device 40E and other components are omitted for clarity of description.

Like the fusing device 40D according to the sixth exemplary embodiment, a controller 65 of the fusing device 40E controls at least one of a power supply 62 and a switching connection unit 64. Various control patterns controlled by the controller 65 will be described. Also, as described above, current directions of the first coil 48, the third coil 50, and the fifth coil 72A are the same.

Figure 23A:
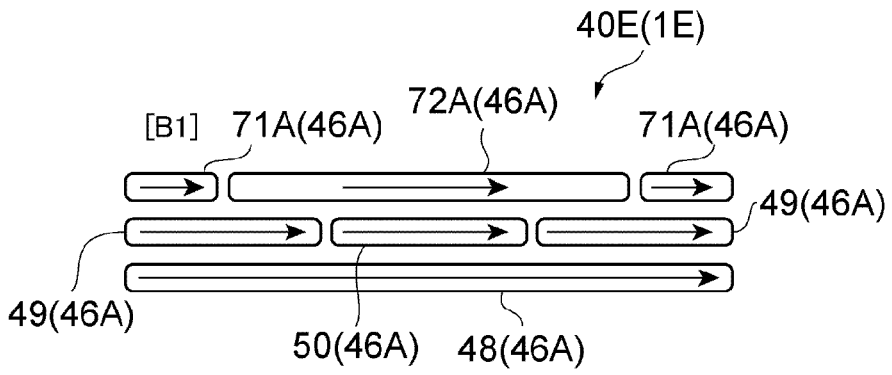
FIGS. 23A to 23F illustrate control patterns of a fusing device according to a seventh exemplary embodiment.
Figure 23B:
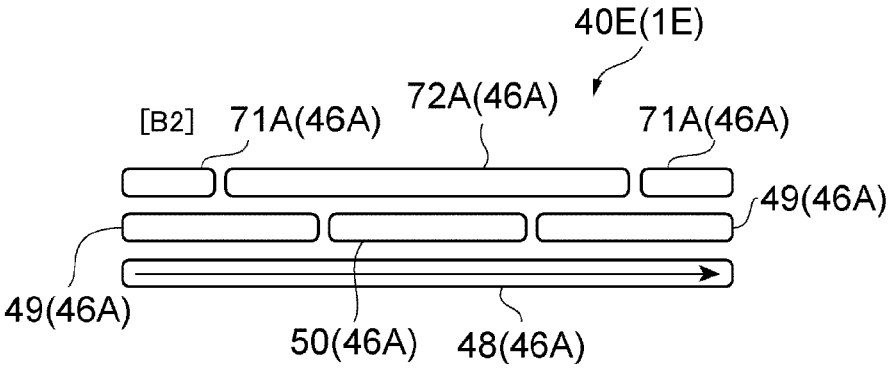
Figure 23C:
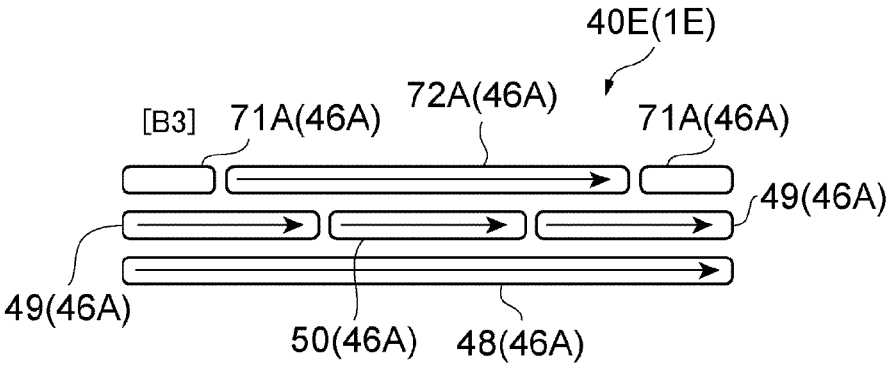
Figure 23D:
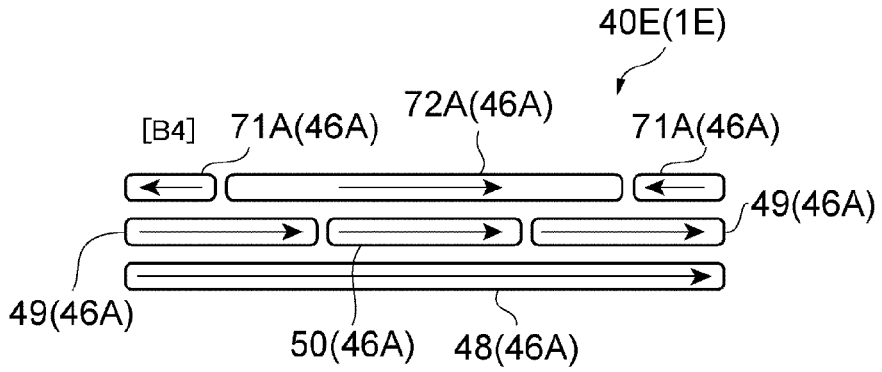
Figure 23E:
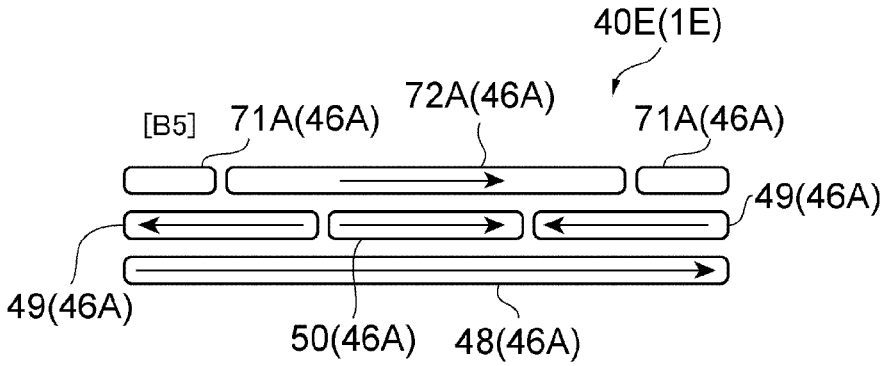
Figure 23F:
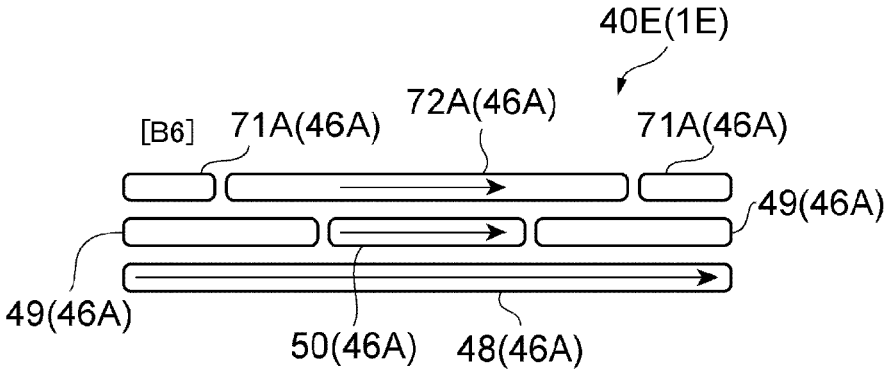

FIGS. 23A to 23F illustrate control patterns B1 to B6, respectively. In the control pattern B1, a serial connection is selected so that current directions of all coils are the same, and power is supplied to all coils (FIG. 23A). In the control pattern B2, power is supplied only to the first coil 48 (FIG. 23B). In the control pattern B3, a serial connection type is selected so that the current directions of all coils, other than the fourth coils 71A, are the same, and power is supplied to the coils, other than the fourth coils 71A (FIG. 23C). In the control pattern B4, a serial connection type is selected so that a current direction of the fourth coils 71A is different from current directions of the rest of the coils, and power is supplied to all coils (FIG. 23D). In the control pattern B5, a serial connection type is selected so that a current direction of the second coils 49 is opposite to that of the first coil 48, and power is supplied to all coils, other than the fourth coils 71A (FIG. 23E). In the control pattern B6, a serial connection type is selected so that power is supplied to all coils, other than the second coils 49 and the fourth coils 71A (FIG. 23F).

Figure 24A:
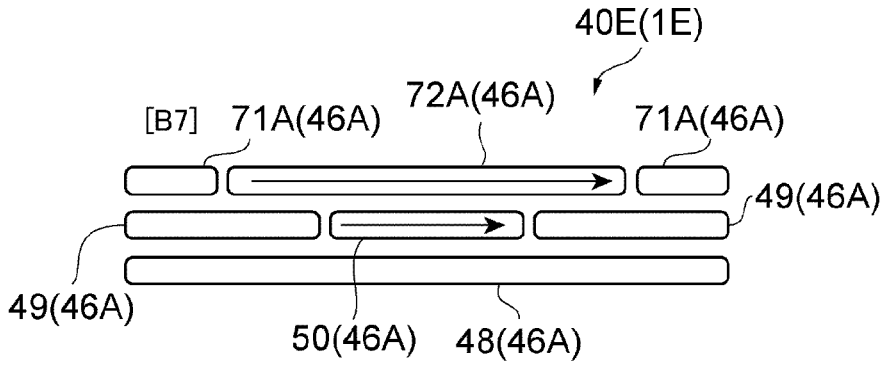
FIGS. 24A to 24F illustrates control patterns of a fusing device according to a seventh exemplary embodiment.
Figure 24B:
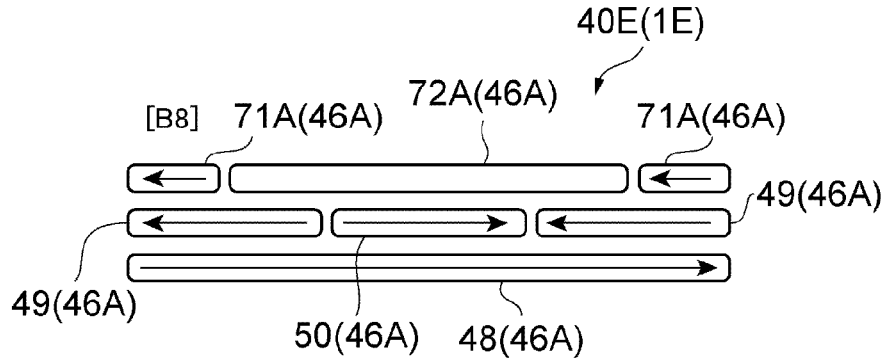
Figure 24C:
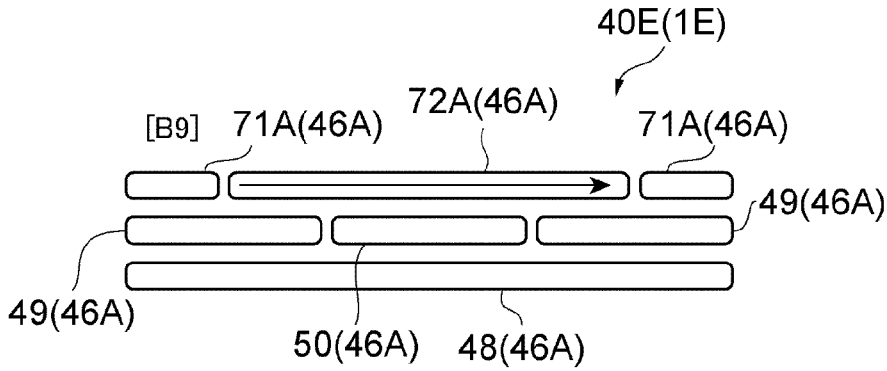
Figure 24D:
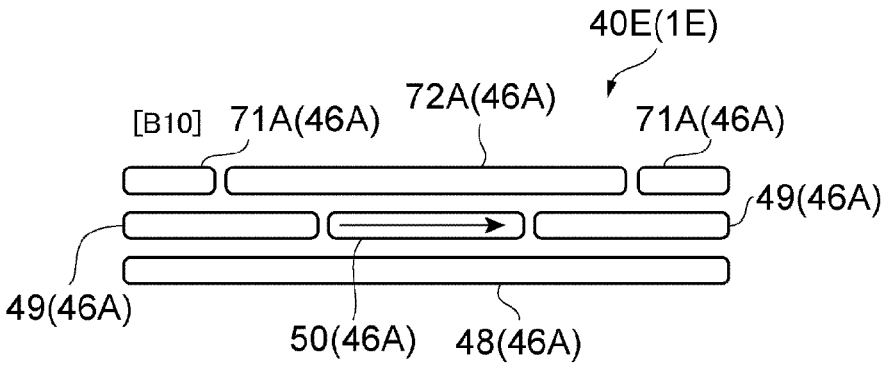
Figure 24E:
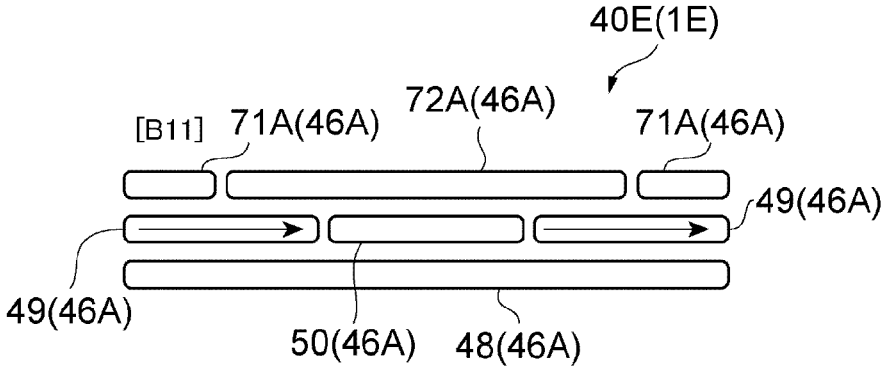
Figure 24F:
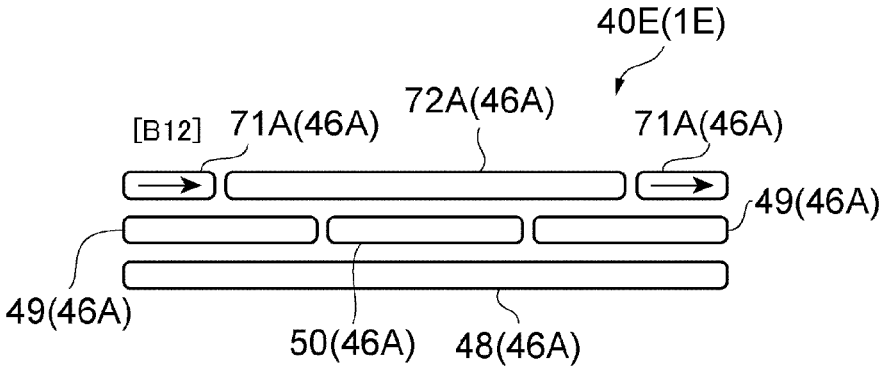

FIGS. 24A to 24F illustrate control patterns B7 to B12, respectively. In the control pattern B7, power is supplied to all coils, other than the first coil 48, the second coils 49, and the fourth coils 71A (FIG. 24A). In the control pattern B8, a serial connection type is selected so that current directions of the second coils 49 and the fourth coils 71A are opposite to current directions of other coils, and power is supplied to all coils, other than the fifth coil 72A (FIG. 24B). In the control pattern B9, power is supplied only to the fifth coil 72A (FIG. 24C). In the control pattern B10, power is supplied only to the third coil 50 (FIG. 24D). In the control pattern B11, power is supplied only to the second coils 49 (FIG. 24E). In the control pattern B12, power is supplied only to the fourth coils 71A (FIG. 24F).

An example of setting the control patterns is illustrated in FIG. 25. Various conditions used to determine the control patterns are the same as the conditions used to determine the control patterns of FIG. 22 in the fifth exemplary embodiment. Also, referring to the example of the control pattern of FIG. 25, a length of the first coil 48 in the axial direction D1 is about 300 mm, a length of each of the second coils 49 and the third coil 50 in the axial direction D1 is about 100 mm, a length of the fourth coils 71A in the axial direction D1 is about 50 mm, and a length of the fifth coil 72A in the axial direction D1 is about 200 mm.

For example, when the paper is regular paper, has a width ranging from about 151 to about 200 mm and is in a paper feeding state, and when a temperature of the heating rotor 44 is equal to or above the target temperature +3□, the control pattern B9 is selected. Also, when the paper is regular paper, has a width of less than 100 mm, and is in the paper feeding state, and when a temperature of the heating rotor 44 is equal to or above the target temperature +3□, the control pattern OFF is selected. The control pattern OFF indicates that a control pattern is not newly set.

Eighth Exemplary Embodiment

Figure 26:
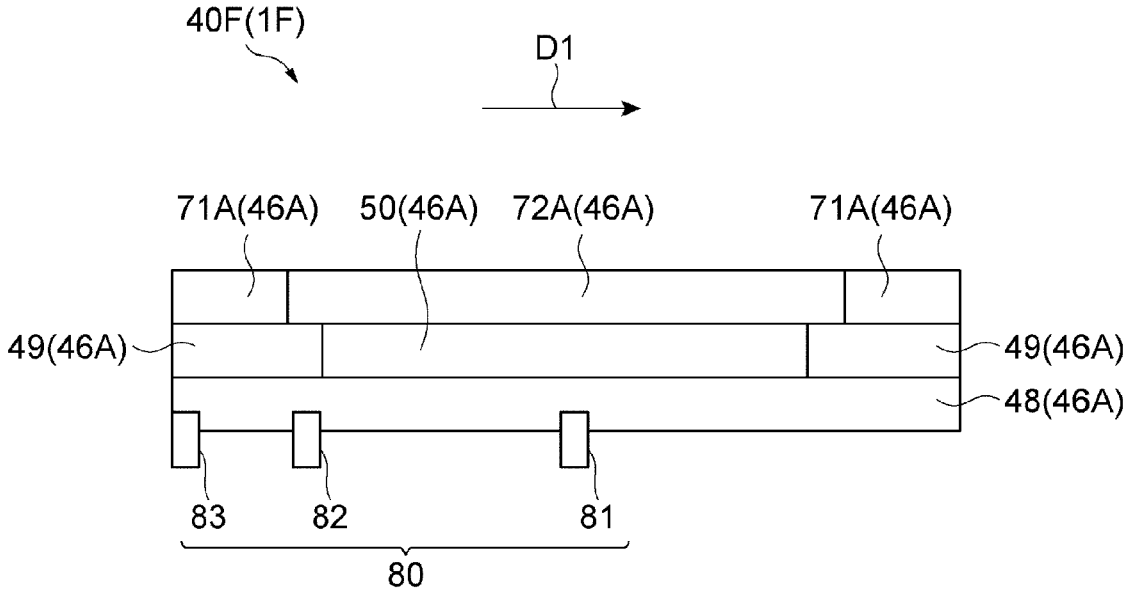
FIG. 26 illustrates a diagram of a temperature detection sensor of a fusing device according to an eighth exemplary embodiment.
Figure 27:
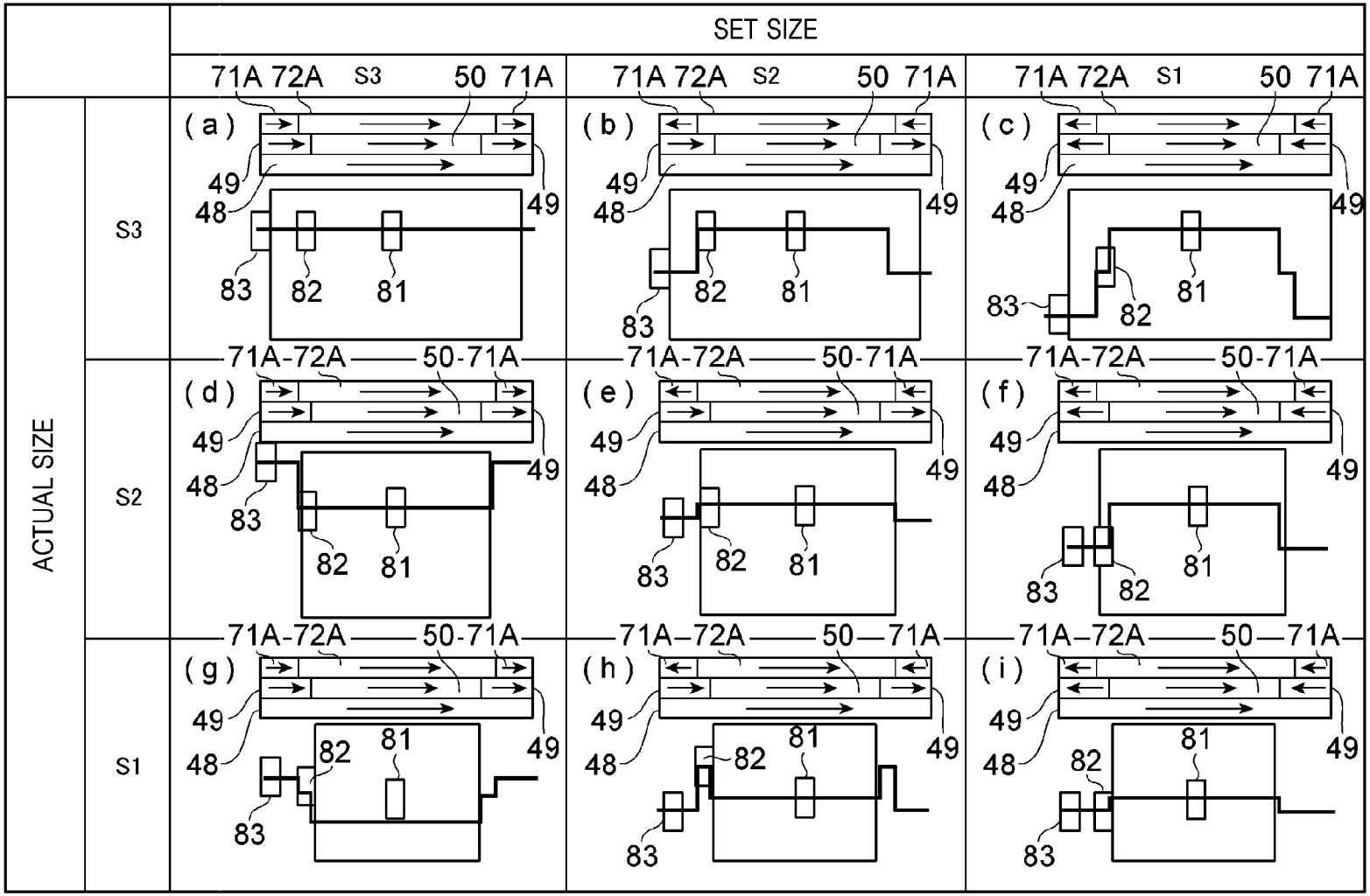
FIG. 27 illustrates a temperature distribution of a heating element with respect to each paper size.

Referring to FIGS. 26 and 27 in addition to FIGS. 1 to 25, an image forming apparatus 1F according to the eighth exemplary embodiment will be described.

As illustrated in FIG. 26, the image forming apparatus 1F may include a fusing device 40F. The fusing device 40F includes the coil module 46A (refer to FIGS. 10 and 11A-11C) like the fusing device 40A. Also, the fusing device 40F includes a temperature detection sensor 80 configured to detect a temperature of the heating rotor 44. FIG. 26 only illustrates components regarding the coil module 46A and the temperature detection sensor 80 from among components of the fusing device 40F for clarity of description. For convenience, FIG. 26 illustrates that the temperature detection sensor 80 is arranged on the coil module 46A, but the temperature detection sensor 80 may be actually arranged right under or adjacent to the heating rotor 44.

The temperature detection sensor 80 may include a first temperature detection sensor 81, a second temperature detection sensor 82, and a third temperature detection sensor 83. The first temperature detection sensor 81 detects a temperature of a region of the heating rotor 44 that overlaps central portions of the first coil 48, the third coil 50, and the fifth coil 72A in widthwise directions (the axial direction D1) thereof. The second temperature detection sensor 82 detects a temperature of a region of the heating rotor 44 that overlaps in the facing direction D2 a region where the first coil 48, the third coil 50, and the fifth coil 72A overlap each other. The third temperature detection sensor 83 detects a temperature of a region of the heating rotor 44 that overlaps in the facing direction D2 a region where the second coils 49 overlap the fourth coils 71A.

Whether the temperature distribution of the heating rotor 44 is abnormal may be determined based on values obtained by the temperature detection sensor 80. Accordingly, whether paper having a wrong size (e.g., having a size different from a set size) is fed to the heating rotor 44 may be determined. Hereinafter, this will be described in detail with reference to FIG. 27.

FIG. 27 illustrates a temperature distribution of the heating rotor 44 according to sizes (actual sizes) of paper that is actually fed with respect to predetermined sizes of paper (set sizes). In the fusing device 40F, first paper S1, second paper S2 having a greater width than the first paper S1, and third paper S3 having a greater width than the second paper S2 may be fed. Also, a length of the first coil 48 in the axial direction D1 is greater than the width of the third paper S3. Also, a length of the third coil 50 in the axial direction D1 is smaller than the width of the second paper S2, but greater than the width of the first paper S1. Also, a length of the fifth coil 72A in the axial direction D1 is smaller than the width of the third paper S3, but greater than the width of the second paper S2. A paper feeding error may be properly determined by the temperature detection sensor 80 by using paper having various sizes and coils.

In addition, in order to increase the accuracy of the determination of the paper feeding error made by the temperature detection sensor 80, it may be advantageous that the length of the first coil 48 in the axial direction D1 is about 5% to about 10% greater than the width of the third paper S3. Also, it may be advantageous that the length of the third coil 50 in the axial direction D1 is about 5% to about 10% greater than the width of the first paper S1. Also, it may be advantageous that the length of the fifth coil 72A in the axial direction D1 is about 5% to about 10% greater than the width of the second paper S2.

A case where a set size matches with an actual size, that is, a case where a paper feeding error does not occur, will be described. For example, there is a case where the set size is a size of the third paper S3, and current directions of all coils are the same. When the third paper S3 having a greater width than the fifth coil 72A is fed when the current directions of all coils are the same (FIG. 27(*a*)), detection portions of the temperature detection sensors 80 become paper feeding portions. Therefore, temperatures respectively detected by the first temperature detection sensor 81, the second temperature detection sensor 82, and the third temperature detection sensor 83 may be the same. When the set size is the size of the third paper S3, and when all values of the temperature detection sensor 80 are the same, it may be determined that the paper feeding error does not occur.

Also, as another example, there is a case where a set size is a size of the second paper S2, and only a current direction of the fourth coils 71A is opposite to current directions of other coils. When the second paper S2 having a width greater than that of the third coil 50 and smaller than that of the fifth coil 72A is fed when the current direction of the fourth coils 71A is opposite to the current directions of other coils (FIG. 27(*e*)), a value of the third temperature detection sensor 83 is decreased by a predetermined value in comparison with values of the first temperature detection sensor 81 and the second temperature detection sensor 82. A detection portion of the third temperature detection sensor 83 becomes a non-paper feeding portion. When the set size is the size of the second paper S2 and when the value of the third temperature detection sensor 83 is only decreased by a predetermined value, it may be determined that the paper feeding error does not occur.

Also, as another example, there is a case where a set size is a size of the first paper S1, and the current direction of the fourth coils 71A and a current direction of the second coils 49 are opposite to the current directions of other coils. When the first paper S1 having a smaller width than the third coil 50 is fed when the current direction of the fourth coils 71A and the current direction of the second coils 49 are opposite to the current directions of other coils (FIG. 27(*i*)), values of the second temperature detection sensor 82 and the third temperature detection sensor 83 are decreased by a predetermined value in comparison with a value of the first temperature detection sensor 81. Detection portions of the second temperature detection sensor 82 and the third temperature detection sensor 83 become non-paper feeding portions. When the set size is the size of the first paper S1 and when the values of the second temperature detection sensor 82 and the third temperature detection sensor 83 are decreased by a predetermined value in comparison with the value of the first temperature detection sensor 81, it may be determined that the paper feeding error does not occur.

When a set size does not match an actual size, that is, when a paper feeding error occurs, the temperature detection sensor 80 detects temperature values different from the above mentioned temperature values when the paper feeding error does not occur. For example, when a set size is a size of the third paper S3, but the second paper S2 is provided (FIG. 27(*d*)), only a value of the temperature of the third temperature detection sensor 83 increases in comparison with values of the first and second temperature detection sensors 81 and 82. A temperature difference occurs when a portion of heat in a region where the paper passes is transferred to the paper, and thus, a temperature of the region becomes lower than a temperature of a region where the paper does not pass. In this case, since values of the temperature detection sensors 80 are to be the same, a controller 65 may determine that the error related to paper feeding occurs. Also, since the detection values of temperature are almost the same as those of when the second paper S2 is provided (that is, detection values of the first and second temperature detection sensors 81 and 82 are almost the same and a detection value of the third temperature detection sensor 83 is different from the detection values of the first and second temperature detection sensors 81 and 82), the controller 65 changes a set size to a size of the second paper S2. Accordingly, the controller 65 may change a set size to a proper set size when detection values of temperature are different from those according to the set size.

Ninth Exemplary Embodiment

Figure 28:
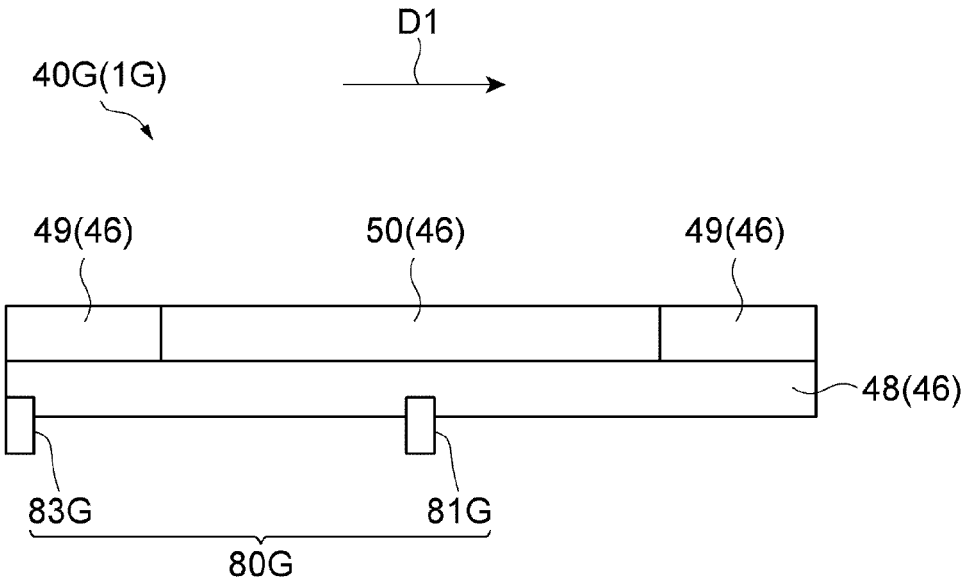
FIG. 28 illustrates a diagram of a temperature detection sensor of a fusing device according to a ninth exemplary embodiment.
Figure 29:
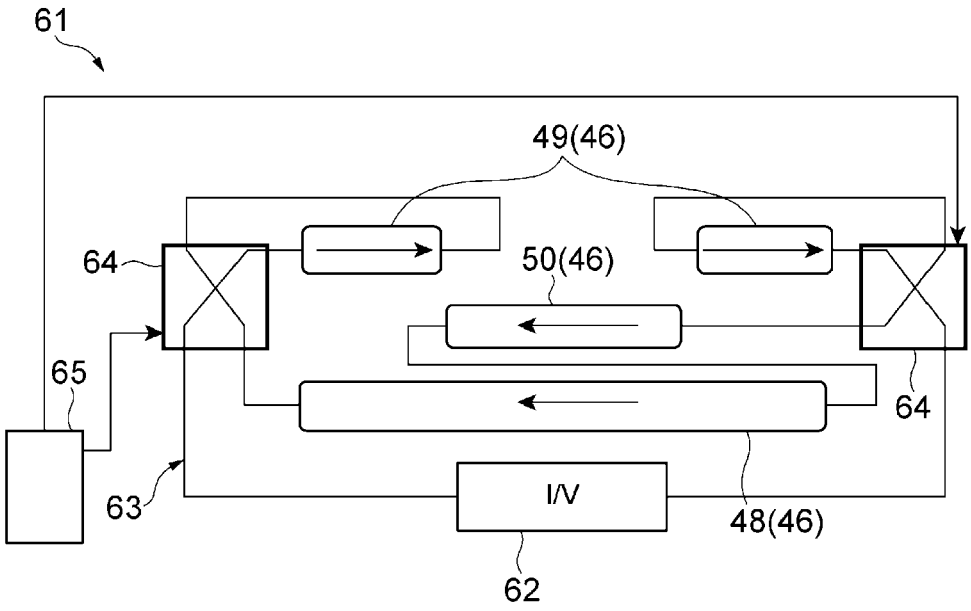
FIG. 29 illustrates that the first and third coil current directions are switched, and the current direction of the second coil is maintained.
Figure 30:
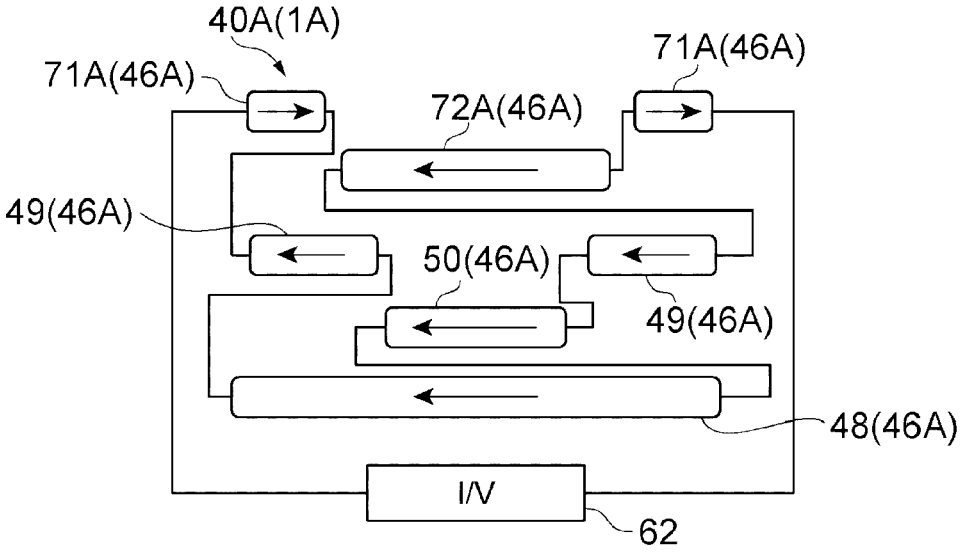
FIG. 30 illustrates that the first, third, and fifth coil current directions are switched with respect to the fourth coil current direction. In other words, the current direction of the fourth coil is maintained, and the current direction of the first, second, third, and fifth coils is reversed.
Figure 31:
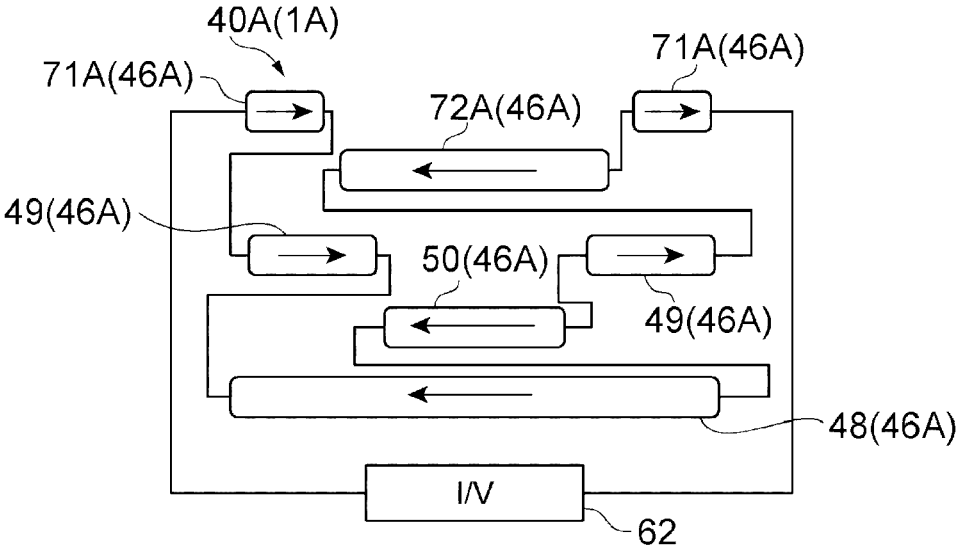
FIG. 31 illustrates that the first, third, and fifth coil current directions are switched with respect to the fourth coil and second coil current direction. In other words, the current direction of the second and fourth coils is maintained, and the current direction of the first, third, and fifth coils is reversed.

Referring to FIG. 28 in addition to FIGS. 1 to 27, an image forming apparatus 1G according to the ninth exemplary embodiment will be described.

As illustrated in FIG. 28, the image forming apparatus 1G includes a fusing device 40G. The fusing device 40G includes a temperature detection sensor 80G configured to detect a temperature of a heating rotor 44. Also, FIG. 28 only illustrates a coil module 46, from among components of the fusing device 40G, and components of the temperature detection sensor 80G for clarity of description. Also, referring to FIG. 28, the temperature detection sensor 80G is arranged on the coil module 46 for convenience, but the temperature detection sensor 80G may be actually arranged right under or adjacent to the heating rotor 44.

In the fusing device 40F according to the eighth exemplary embodiment illustrated in FIG. 26, three temperature detection sensors 80 are installed for the coil module 46A having a tri-layered structure. On the other hand, in the fusing device 40G, two temperature detection sensors 80 are installed for the coil module 46 having the two-layered structure. That is, a first temperature detection sensor 81G and a second temperature detection sensor 83G are installed.

The first temperature detection sensor 81G detects a temperature of a region of the heating rotor 44 that overlaps in the facing direction D2 the central portions of the first coil 48 and the third coil 50 in the axial direction D1. The second temperature detection sensor 83G detects a temperature of a region of the heating rotor 44 that overlaps in the facing direction D2 a region where the first coil 48 overlaps the second coils 49 in the facing direction D2.

Based on the above-described structure, in a coil like the coil module 46 having a two-layered structure including the first coil 48, the second coils 49, and the third coil 50, an error related to paper feeding may be detected. That is, according to a temperature of the first temperature detection sensor 81G and that of the second temperature detection sensor 83G, an error related to an actual size which is different from a set size may be detected.

While one or more exemplary embodiments have been described, the inventive concept is not limited to the described exemplary embodiments. For example, it has been described that the number of turns of the second coils 49 and the number of turns of the third coil 50 are less than the number of turns of the first coil 48, but the inventive concept is not limited thereto. Thus, the number of turns of the second coils 49 and the number of turns of the third coil 50 may be equal to or greater than the number of turns of the first coil 48.

Also, it has been described that inner widths IW2 of the second coils 49 and the third coil 50 are greater than an inner width IW1 of the first coil 48 and that outer widths OW2 of the second coils 49 and the third coil 50 are less than an outer width OW1 of the first coil 48. However, the inventive concept is not limited thereto. That is, the inner widths IW2 may be equal to or less than the inner width IW1, and the outer widths OW2 may be equal to or greater than the outer width OW1.

Also, it has been described that the number of turns of the second coils 49 and the number of turns of the third coil 50 are the same, but they may be different from each other. In addition, the first coil 48 may not be always arranged to be closer to the core module 47 than the second coils 49 and the third coil 50. Moreover, there may be some exemplary embodiments in which the core module 47 is not installed. Also, coils may not be separated from each other, and for example, the first coil 48 and the third coil 50, in which a current flows in the same direction, may be integrally formed.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A fusing device comprising:

a heating element that is rotatable; and a coil module circuit configured to generate a magnetic flux for heating the heating element and comprising a coil module facing an outer circumference surface of the heating element and arranged to be separated from the outer circumference surface of the heating element in a facing direction, and a power supply configured to supply power to the coil module, wherein the coil module comprises:

a first coil arranged in a widthwise direction of the heating element;

a pair of second coils arranged to overlap in the facing direction both end portions of the first coil in the widthwise direction; and a single third coil arranged to overlap in the facing direction a central portion of the first coil in the widthwise direction, a first end of the third coil being adjacent to one of the pair of second coils, and a second end of the third coil being adjacent to the other of the pair of second coils, and wherein the coil module circuit comprises a switching connection unit configured to switch serial connections of the first coil, the second coils, and the third coil in order to switch current directions of the first coil and the third coil with respect to the second coils, or switch the current direction of the second coils with respect to the first coil and the third coil.

2. The fusing device of claim 1, wherein a number of turns of each of the second coils is less than a number of turns of the first coil.

3. The fusing device of claim 1, wherein, in a rotation direction of the heating element, inner widths of the second coils and the third coil are greater than an inner width of the first coil, and outer widths of the second coils and the third coil are less than an outer width of the first coil.

4. The fusing device of claim 1, wherein the second coils and the third coil are at same distance from the heating element in the facing direction and have a same number of turns.

5. The fusing device of claim 1, wherein the second coils and the third coil are arranged to have a structure in which end portions of the second coils and the third coil in the widthwise direction are adjacent to each other, a structure in which the end portions of the second coils and the third coil in the widthwise direction are separated from each other, or a structure in which a distance from the heating element to the second coils in the facing direction is different from a distance from the heating element to the third coil in the facing direction and the end portions of the second coils and the third coil in the widthwise direction overlap each other.

6. The fusing device of claim 1, further comprising a core module configured to concentrate magnetic fluxes generated by the first coil, the second coils, and the third coil toward the heating element, the core module comprising a plurality of cores, wherein the core module is arranged to overlap at least the second coils and the third coil in the widthwise direction.

7. The fusing device of claim 6, wherein the first coil is arranged closer to the core module than the second coils and the third coils in the facing direction.

8. The fusing device of claim 6, wherein the core module comprises:

a connection unit configured to overlap in the facing direction a connection region between the third coil and the second coils; and a main unit configured to overlap a region of the coil module other than the connection region, wherein the connection unit and the main unit have a structure in which the connection unit and the main unit have the same arrangement densities and the same permeability, a structure in which permeabilities of the connection unit and the main unit are different from each other, or a structure in which distances from the heating element to the connection unit and the main unit in the facing direction are different from each other.

9. The fusing device of claim 1, wherein a ratio of magnetic fluxes generated by the second coils and the third coil to a magnetic flux generated by the first coil is less than or equal to about 50%.

10. The fusing device of claim 1, wherein the coil module further comprises:

a pair of fourth coils arranged to overlap in the facing direction the end portions of the first coil and the second coils in the widthwise direction; and a fifth coil arranged to overlap in the facing direction the central portions of the first coil and the third coil in the widthwise direction, wherein a ratio of a length of the fourth coil to a length of the fifth coil in the widthwise direction is different from a ratio of a length of the second coils to a length of the third coil in the widthwise direction, the switching connection unit is configured to switch serial connections of the first coil, the second coils, the third coil, the fourth coils, and the fifth coil in order to switch current directions of the fourth coils with respect to the first coil, the third coil, and the fifth coil, or switch current directions of the first coil, the third coil, and the fifth coil with respect to the fourth coils.

11. The fusing device of claim 10, wherein a ratio of magnetic fluxes generated by the fourth coils and the fifth coil to a magnetic flux generated by the first coil is less than or equal to about 50%.

12. The fusing device of claim 1, wherein the coil module circuit further comprises a controller configured to control at least one of the power supply and the switching connection unit, wherein the controller is further configured to set a control pattern of the at least one of the power supply and the switching connection unit at a time at which paper is ready to be fed to the fusing device, at a time at which paper starts being fed to the fusing device, at a time at which paper is continuously fed to the fusing device, and at a time at which paper is finished being fed to the fusing device.

13. The fusing device of claim 12, wherein the control pattern comprises a pattern for setting supply and interruption of power supply by the power supply.

14. The fusing device of claim 12, wherein the control pattern comprises a pattern for setting a serial connection type of the coil module, the setting being performed by the switching connection unit.

15. The fusing device of claim 12, wherein the controller operates based on a plurality of control patterns.

16. The fusing device of claim 15, wherein the controller is further configured to determine a control pattern from among the plurality of control patterns according to at least one of a width of a recording medium, a thickness of a recording medium, and a difference between a measured temperature and a target temperature of the heating element.

17. The fusing device of claim 1, further comprising:

a first temperature detection sensor configured to detect a temperature of a region overlapping in the facing direction central portions of the first coil and the third coil in the widthwise direction, from among regions of the heating element; and a second temperature detection sensor configured to detect a temperature of a region overlapping in the facing direction a region where the first coil overlaps the second coils in the facing direction, from among the regions of the heating element.

18. The fusing device of claim 17, wherein the coil module further comprises:

a pair of fourth coils arranged to overlap in the facing direction end portions of the first coil and the second coils in the widthwise direction; and a fifth coil arranged to overlap in the facing direction central portions of the first coil and the third coil in the widthwise direction, wherein the fifth coil is arranged to overlap in the facing direction an end portions of the second coils, which are adjacent to the third coil, the fusing device further comprises a third temperature detection sensor configured to detect a temperature of a region overlapping in the facing direction a region where the second coils overlap the fifth coil from among regions of the heating element, the first temperature detection sensor is configured to detect a temperature of a region overlapping in the facing direction the central portions of the first coil and the third coil and a central portion of the fifth coil in the widthwise direction, from among regions of the heating element, and the second temperature detection sensor is configured to detect a temperature of a region overlapping in the facing direction a region where the first coil, the second coils, and the fifth coil overlap each other, from among the regions of the heating element.

19. The fusing device of claim 18, wherein, when a first recording medium, a second recording medium having a greater width than the first recording medium, and a third recording medium having a greater width than the second recording medium are fed to the fusing device, a length of the first coil in the widthwise direction is greater than a width of the third recording medium, a length of the third coil in the widthwise direction is less than a width of the second recording medium, but is greater than a width of the first recording medium, and a length of the fifth coil in the widthwise direction is less than a width of the third recording medium, but is greater than the width of the second recording medium.

20. An image forming apparatus comprising a fusing device comprising:

a heating element that is rotatable; and a coil module circuit configured to generate a magnetic flux for heating the heating element and comprising a coil module facing an outer circumference surface of the heating element and arranged to be separated from the outer circumference surface of the heating element in a facing direction, and a power supply configured to supply power to the coil module, wherein the coil module comprises:

a first coil arranged in a widthwise direction of the heating element;

a pair of second coils arranged to overlap in the facing direction both end portions of the first coil in the widthwise direction; and a single third coil arranged to overlap in the facing direction a central portion of the first coil in the widthwise direction, a first end of the third coil being adjacent to one of the pair of second coils, and a second end of the third coil being adjacent to the other of the pair of second coils, and wherein the coil module circuit comprises a switching connection unit configured to switch serial connections of the first coil, the second coils, and the third coil in order to switch current directions of the first coil and the third coil with respect to the second coil, or switch the current direction of the second coils with respect to the first coil and the third coil.

21. A fusing device comprising:

a heating roller having two end regions and an inner region between the two end regions;

a coil module comprising:

a first coil arranged along an axial direction of the heating roller;

two second coils, one second coil arranged in each end region of the heating roller; and a single third coil arranged in the inner region of the heating roller, a first end of the third coil being adjacent to one of the pair of second coils, and a second end of the third coil being adjacent to the other of the pair of second coils; and a controller configured to switch current directions of currents in the first coil, the second coils, and the third coil.

22. The fusing device of claim 21, wherein the controller switches the current directions of the currents in the first coil, the second coils, and the third coil to be in the same direction, or the controller switches the current directions of the currents in the first coil and the third coil to be opposite to the current direction of the currents in the second coils.

23. The fusing device of claim 21, further comprising a core module configured to concentrate magnetic fluxes generated by the first coil, the second coils, and the third coil toward the heating roller, the core module comprising a plurality of cores, wherein the cores are arranged at intervals along the axial direction.

24. The fusing device of claim 23, wherein the cores are arranged to overlap seams between the third coil and the second coils.

25. The fusing device of claim 21, wherein the coil module further comprises:

two fourth coils, one fourth coil arranged in a portion of each end region; and a fifth coil arranged in a region between the fourth coils, wherein each second coil overlaps a corresponding seam between the fifth coil and the fourth coils, and wherein the controller further controls current directions of currents in the fourth coils and the fifth coil.

* * * * *